US012396556B2

(12) United States Patent
Li

(10) Patent No.: US 12,396,556 B2
(45) Date of Patent: Aug. 26, 2025

(54) SHELVING SYSTEM

(71) Applicant: HANGZHOU GREAT STAR INDUSTRIAL CO., LTD., Hangzhou (CN)

(72) Inventor: Yueming Li, Hangzhou (CN)

(73) Assignee: HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 247 days.

(21) Appl. No.: 17/295,707

(22) PCT Filed: Apr. 1, 2021

(86) PCT No.: PCT/CN2021/084828
§ 371 (c)(1),
(2) Date: May 20, 2021

(87) PCT Pub. No.: WO2022/165969
PCT Pub. Date: Aug. 11, 2022

(65) Prior Publication Data

US 2022/0248848 A1 Aug. 11, 2022

(30) Foreign Application Priority Data

Feb. 5, 2021 (CN) ..... 202110163503.0

(51) Int. Cl.
*A47B 96/02* (2006.01)
*A47B 55/02* (2006.01)
(Continued)

(52) U.S. Cl.
CPC ..... *A47B 96/028* (2013.01); *A47B 55/02* (2013.01); *A47B 57/06* (2013.01); *A47B 47/022* (2013.01);
(Continued)

(58) Field of Classification Search
CPC ..... A47B 96/028; A47B 55/02; A47B 57/06; A47B 57/08; A47B 57/10; A47B 57/16;
(Continued)

(56) References Cited

U.S. PATENT DOCUMENTS 4,324,379 A * 4/1982 Ovitz, III ..... A47B 57/42 D8/381
4,406,374 A * 9/1983 Yedor ..... A47B 57/408 403/317
(Continued)

FOREIGN PATENT DOCUMENTS

CN 2623088 7/2004
CN 201221588 4/2009
(Continued)

*Primary Examiner* — Devin K Barnett
(74) *Attorney, Agent, or Firm* — Fitch, Even, Tabin & Flannery LLP

(57) ABSTRACT

A shelving system comprises a horizontal beam, a vertical beam, a bracket, a rack, and a position-limiting piece. The vertical beam is slidably connected to the horizontal beam, the bracket is detachably connected to the vertical beam, the rack is in contact with an upper edge of the bracket, the position-limiting piece is detachably connected to the bracket through a gasket, and the position-limiting piece is connected to the bracket and can prevent the rack from moving relative to the bracket. In the present application, the strength of a connecting part between the bracket and the vertical beam is enhanced by the gasket, and the stability of the bracket and the rack is increased by the position-limiting piece, thereby improving the goods carrying capacity of the shelving system as a whole.

2 Claims, 15 Drawing Sheets

(51) Int. Cl.
*A47B 57/06* (2006.01)
*A47B 47/02* (2006.01)
*A47B 57/16* (2006.01)
*A47B 57/40* (2006.01)

(52) U.S. Cl.
CPC ..... *A47B 57/16* (2013.01); *A47B 57/40* (2013.01); *A47B 96/027* (2013.01)

(58) Field of Classification Search
CPC ..... A47B 57/20; A47B 57/30; A47B 57/32; A47B 57/34; A47B 47/00; A47B 57/40; A47B 57/38; A47B 47/022; A47B 96/06; A47B 96/027
See application file for complete search history.

(56) References Cited

U.S. PATENT DOCUMENTS 4,411,400 A * 10/1983 Everett ..... A47B 57/42 248/216.1
4,971,281 A * 11/1990 Steinbeck ..... A47B 96/06 248/222.13
5,063,715 A * 11/1991 Goodman ..... E04B 2/7416 248/245
5,110,080 A * 5/1992 Rieman ..... A47B 96/1408 248/225.11
5,346,077 A * 9/1994 Randall ..... A47B 96/028 211/90.03
6,109,461 A * 8/2000 Kluge ..... A47B 57/30 211/187
6,402,108 B1 * 6/2002 Remmers ..... A47B 57/42 211/90.03
D490,697 S * 6/2004 Runnalls ..... D8/380
6,932,225 B2 * 8/2005 Rowe ..... A47B 57/30 211/90.02
7,086,543 B2 * 8/2006 Remmers ..... A47H 99/00 211/186
7,188,740 B2 * 3/2007 Marchetta ..... A47B 47/022 211/90.03
7,240,803 B2 * 7/2007 Stitchick ..... A47B 96/061 211/90.03
7,314,144 B2 * 1/2008 Stitchick ..... A47B 96/061 211/90.03
7,401,705 B2 * 7/2008 Craft ..... A47B 96/00 211/113
D589,780 S * 4/2009 Fernandez ..... D8/336
7,967,268 B2 * 6/2011 Herron, III ..... A47B 57/42 108/106
8,128,182 B2 * 3/2012 DeWeerd ..... A47F 5/103 312/247
8,646,624 B2 * 2/2014 Fernandez ..... A47B 47/022 211/90.03
8,720,704 B2 * 5/2014 Gupta ..... A47B 96/025 211/74
10,634,279 B2 * 4/2020 Lu ..... A47B 96/1441
11,583,074 B2 * 2/2023 Nilsson ..... A47B 57/42
2005/0150436 A1 * 7/2005 Marchetta ..... A47B 96/028 108/108
2006/0011568 A1 * 1/2006 Remmers ..... A47B 96/00 211/90.03
2006/0175495 A1 * 8/2006 Gregory ..... A47B 96/028 248/250
2007/0221597 A1 * 9/2007 Chen ..... A47B 57/40 211/192
2008/0074021 A1 3/2008 Croft et al.
2009/0139943 A1 * 6/2009 Fernandez ..... A47F 5/0869 211/94.01
2010/0032394 A1 * 2/2010 Wang ..... A47F 5/0838 211/90.01
2012/0119043 A1 * 5/2012 Rataiczak, III ..... A47B 96/061 248/218.4
2015/0090683 A1 4/2015 Sabounjian
2022/0151384 A1 * 5/2022 Hu ..... A47B 96/021

FOREIGN PATENT DOCUMENTS

CN 202959431 A 6/2013
CN 204078140 1/2015
CN 105105524 A 12/2015
CN 205913129 U 2/2017
CN 207055401 U 3/2018
CN 207639908 U 7/2018
CN 110425815 11/2019
CN 211154632 U 8/2020
CN 211961257 11/2020
CN 217185337 U 8/2022

* cited by examiner

SHELVING SYSTEM

CROSS-REFERENCE TO RELATED APPLICATIONS

This application is a U.S. national phase application of International Application No. PCT/CN2021/084828, filed Apr. 1, 2021, which claims priority to Chinese Patent Application No. 202110163503.0, filed Feb. 5, 2021.

FIELD OF THE INVENTION

The present application relates to a mechanically fixed and connected system, and in particular to a shelving system.

DESCRIPTION OF THE PRIOR ART

Shelves are commonly used equipment in daily life. Household shelves are usually used to place clothes, daily necessities, etc., and commercial shelves are usually used to place commodities and products. Among them, shelves installed on vertical surfaces are widely used in supermarkets and shopping malls because of their small footprints. A shelf of this kind usually has a plurality of brackets fixedly installed on a vertical wall surface or a board surface, and then a rack is placed horizontally on the brackets to form a shelf Another common form of shelves is to fixedly install a horizontal beam or a vertical beam on a wall surface or a board surface, and then after the bracket is fixedly connected to the horizontal beam or the vertical beam, a rack is installed on the bracket.

Regardless of the form, it is desirable that the shelf can carry more goods, as well as heavier weight. However, with regard to the shelving system in the prior art, the carrying capacity of the entire shelving system is limited due to the following problems:

1. In an existing shelving system, the bonding force between a horizontal beam and a wall surface/board surface is not enough, which easily causes the horizontal beam to deform and fall off.
2. In an existing shelving system, several screws are usually used to fix a horizontal beam to a vertical surface such as a wall surface and a board surface. The screws are inevitably above the plane where the horizontal beam is. However, in the prior art, a joint between a vertical beam and a horizontal beam is in close contact. When the vertical beam needs to be moved along the horizontal beam, the joint between the vertical beam and the horizontal beam easily interferes with the screws. Therefore, in an actual use, if the vertical beam needs to be moved, the vertical beam needs to be detached, such that the joint between the vertical beam and the horizontal beam is prone to wear, resulting in insufficient carrying capacity.
3. In an existing shelving system, the strength of a connecting part between a bracket and a vertical beam is not enough, which easily causes the bracket or the vertical beam to deform.
4. In an existing shelving system, a connection between a bracket and a vertical beam is unstable. The bracket is easy to slide in a horizontal or vertical direction, which causes a rack to be unstable consequently as well, thus affecting the carrying capacity of the entire shelving system.

5. In an existing shelving system, spacings between metal wires of the grid-like rack are relatively large, which makes the shelf not suitable for carrying small items.
6. In an existing shelving system, in order to form a longer shelving system, a common solution is to splice racks together, and a splicing mechanism is usually required, resulting in a complicated shelving system.

Therefore, those skilled in the art devote themselves to developing a shelving system to solve the problems in the prior art and improve the load-bearing capacity of the shelving system as a whole.

SUMMARY OF THE INVENTION

In view of the above-mentioned shortcomings of the prior art, the technical problem to be solved by the present application is to provide a shelving system which can prevent a rack from being easily disengaged from a bracket during use, reduce the shaking of the shelf, and improve the bearing capacity of a joint.

In order to solve the above technical problem, the present application provides a shelving system which comprises a bracket and a vertical beam, wherein the vertical beam is connected to a vertical surface, and the bracket is connected to the vertical beam.

In some embodiments, optionally, the shelving system further comprises a position-limiting piece, wherein the position-limiting piece is provided at a joint between the bracket and the vertical beam, the position-limiting piece is connected to the bracket, and the position-limiting piece is configured to impede a position change of the bracket relative to the vertical beam.

In some embodiments, optionally, the bracket comprises a bracket wall, and the position-limiting piece is detachably connected to the bracket wall.

In some embodiments, optionally, the position-limiting piece comprises a cam shaft, the bracket wall comprises a cam shaft hole, and the cam shaft is fitted with the cam shaft hole, so as to realize a connection between the position-limiting piece and the bracket wall.

In some embodiments, optionally, the position-limiting piece comprises a retaining rib, and the retaining rib is configured to receive a transverse metal wire.

In some embodiments, optionally, the retaining rib is in an arch shape, and a receiving space is formed under the retaining rib to receive the transverse metal wire.

In some embodiments, optionally, the retaining rib comprises a first petal, one end of the first petal comprises a base, and the first petal is connected to the position-limiting piece through the base.

In some embodiments, optionally, the first petal comprises an end portion, and the end portion is provided at an end away from the base.

In some embodiments, optionally, the retaining rib further comprises a second petal, one end of the second petal comprises a base, and the second petal is connected to the position-limiting piece through the base.

In some embodiments, optionally, the second petal comprises an end portion, and the end portion is provided at an end away from the base.

In some embodiments, optionally, the distance between the base of the first petal and the base of the second petal is greater than the distance between the end portion of the first petal and the end portion of the second petal, and the first petal and the second petal are configured to form a semi-enclosed structure.

In some embodiments, optionally, the first petal and the second petal are arc-shaped, and the semi-enclosed structure is circular or semi-circular for receiving the transverse metal wire.

In some embodiments, optionally, the vertical beam comprises a vertical beam slotted hole, the bracket comprises a lug, and the bracket is inserted into the vertical beam slotted hole through the lug to realize a detachable connection to the vertical beam.

In some embodiments, optionally, the position-limiting piece further comprises a raised rib, and the raised rib is configured to be inserted into the vertical beam slotted hole to reduce a movable space of the bracket relative to the vertical beam.

In some embodiments, optionally, the position-limiting piece comprises a retaining rib and a raised rib, the retaining rib is configured to receive a transverse metal wire, and the raised rib is configured to be connected to the vertical beam to reduce a movable space of the bracket relative to the vertical beam.

In some embodiments, optionally, the position-limiting piece further comprises a pressing portion, and the pressing portion is connected to the raised rib and is configured to be able to drive the raised rib to move toward or away from the vertical beam under the action of an external force.

Another object of the present application is to provide a shelving system which comprises a bracket and a gasket, wherein the gasket is provided on a bracket wall of the bracket, and the gasket is configured to increase the strength of the bracket.

In some embodiments, optionally, the bracket comprises a lug, the lug is a part extending from the bracket wall, and the gasket is fixedly connected to the lug.

In some embodiments, optionally, the lug is provided with a hole, the gasket is provided with a hole, the hole on the lug is aligned with the hole on the gasket, and the lug is fixedly connected to the gasket by a screw or a rivet.

In some embodiments, optionally, the lug and the gasket are fixedly connected by welding.

In some embodiments, optionally, the shelving system further comprises a vertical beam, wherein the vertical beam comprises a vertical beam slotted hole, and the lug and the gasket are configured to be inserted into the vertical beam slotted hole, so as to realize a detachable connection between the bracket and the vertical beam.

In some embodiments, optionally, the lug comprises a first slot, and the first slot is configured to receive an edge of the vertical beam slotted hole.

In some embodiments, optionally, the shape of the gasket matches the shape of the lug.

In some embodiments, optionally, the gasket comprises a second slot, the second slot is provided at a position corresponding to the first slot, and the size of the second slot matches the size of the first slot.

Another object of the present application is to provide a shelving system which comprises a bracket, a gasket and a position-limiting piece, wherein the bracket comprises a bracket wall, the gasket is fixedly connected to the bracket wall, and the position-limiting piece is detachably connected to the gasket.

In some embodiments, optionally, the bracket comprises two bracket walls, the two bracket walls are arranged parallel to each other, and each of the two bracket walls is provided with the gasket.

In some embodiments, optionally, the gasket comprises an engaging groove, and the engaging groove is configured for a connection between the position-limiting piece and the gasket.

In some embodiments, optionally, the position-limiting piece comprises a raised rib, and the position-limiting piece is connected to the gasket through matching between the raised rib and the engaging groove.

In some embodiments, optionally, the raised rib is provided with an engaging portion, the engaging portion is wedge-shaped, and the size of the engaging portion is configured to match that of the engaging groove.

Another object of the present application is to provide a shelving system which comprises a bracket, a position-limiting piece and a gasket, wherein the position-limiting piece and the gasket are integrally formed, and the position-limiting piece is connected to the bracket.

In some embodiments, optionally, the bracket comprises a bracket wall, and the position-limiting piece is connected to the bracket wall through the gasket.

In some embodiments, optionally, the bracket comprises two bracket walls, the two bracket walls are arranged parallel to each other, gaskets are provided on both sides of the position-limiting piece, and the position-limiting piece is connected to the two bracket walls through the gaskets.

In some embodiments, optionally, the position-limiting piece comprises a retaining rib, and the retaining rib and the position-limiting piece are integrally formed.

In some embodiments, optionally, the retaining rib is arc-shaped, and the retaining rib is configured to receive a transverse metal wire.

Another object of the present application is to provide a shelving system which comprises a rack, wherein the rack is configured to be connected to a bracket.

In some embodiments, optionally, the rack is grid-like and comprises at least two longitudinal metal wires, and the longitudinal metal wires are arranged in parallel.

In some embodiments, optionally, the spacing between adjacent longitudinal metal wires is ⅝ inch.

In some embodiments, optionally, the shelving system further comprises a transverse metal wire, wherein the transverse metal wire is flush with the longitudinal metal wire at an end portion of the rack.

In some embodiments, optionally, the shelving system further comprises a bracket, wherein the bracket comprises two bracket walls arranged in parallel, and the spacing between the two bracket walls is less than the spacing between adjacent longitudinal metal wires.

In some embodiments, optionally, longitudinal metal wires belonging to two different racks are contained between the two bracket walls.

In some embodiments, optionally, the rack comprises a frame and a bottom, the frame comprises connecting metal wires, and the rack is connected to the bracket through the connecting metal wires.

In some embodiments, optionally, the bottom is recessed, and the frame is provided on edges of the bottom.

Another object of the present application is to provide a shelving system which comprises a vertical beam, wherein the vertical beam is configured to be connected to a horizontal beam.

In some embodiments, optionally, the vertical beam comprises a first wall of the vertical beam and second walls of the vertical beam, and the first wall of the vertical beam is connected to the second walls of the vertical beam through vertical beam bending portions.

In some embodiments, optionally, the length of the first wall of the vertical beam is 28 mm.

In some embodiments, optionally, the shelving system further comprises third walls of the vertical beam, and the third walls of the vertical beam are connected to the second walls of the vertical beam through vertical beam bending portions.

In some embodiments, optionally, the vertical beam comprises a first matching groove and a second matching groove, and the first matching groove and the second matching groove are configured to fit with the horizontal beam.

In some embodiments, optionally, the first matching groove is rectangular.

In some embodiments, optionally, the second matching groove is wedge-shaped.

In some embodiments, optionally, the vertical beam comprises a vertical beam avoiding groove, and the vertical beam avoiding groove is configured to avoid interference between the vertical beam and a connecting nail.

In some embodiments, optionally, the vertical beam comprises a vertical beam avoiding portion, and the vertical beam avoiding portion is configured to avoid interference between the vertical beam and a connecting nail.

Another object of the present application is to provide a shelving system which comprises a horizontal beam, wherein the horizontal beam is configured to be connected to a vertical surface.

In some embodiments, optionally, the horizontal beam comprises a horizontal beam recess, and the horizontal beam recess is attached to the vertical surface, so as to realize a connection between the horizontal beam and the vertical surface.

In some embodiments, optionally, a first row of connecting nails and a second row of connecting nails are provided on the horizontal beam recess, and the horizontal beam is connected to the vertical surface through the first row of connecting nails and the second row of connecting nails.

Another object of the present application is to provide a shelving system which comprises a bracket, wherein the bracket is configured to be connected to a vertical surface.

In some embodiments, optionally, the bracket comprises a fastening surface, the fastening surface is provided at the tail of the bracket, and the fastening surface is attached to the vertical surface to achieve a connection between the bracket and the vertical surface.

In some embodiments, optionally, a fastening hole is provided on the fastening surface, and the fastening hole is configured to receive a connecting nail.

Another object of the present application is to provide a shelving system which comprises:

- a horizontal beam which is configured to be connected to a vertical surface and comprises a horizontal beam recess, wherein a first row of connecting nails and a second row of connecting nails are provided on the horizontal beam recess; a vertical beam which is detachably connected to the horizontal beam and comprises a vertical beam slotted hole;
- a bracket which is detachably connected to the vertical beam;
- a rack which is fixedly connected to the bracket;
- a gasket which is fixedly connected to the bracket and is configured to increase a local thickness of the bracket; and
- a position-limiting piece which is connected to the bracket and is configured to impede a position change of the rack relative to the bracket.

Another object of the present application is to provide a shelving system which comprises:

- a horizontal beam which is configured to be connected to a vertical surface and comprises a horizontal beam recess, wherein a first row of connecting nails and a second row of connecting nails are provided on the horizontal beam recess;
- a vertical beam which is detachably connected to the horizontal beam and comprises a vertical beam slotted hole;
- a bracket which is detachably connected to the vertical beam;
- a gasket which is fixedly connected to the bracket and is configured to increase a local thickness of the bracket; and
- a position-limiting piece which is connected to the gasket and is configured to impede a position change of a rack relative to the bracket.

Another object of the present application is to provide a shelving system which comprises:

- a horizontal beam which is configured to be connected to a vertical surface and comprises a horizontal beam recess, wherein a first row of connecting nails and a second row of connecting nails are provided on the horizontal beam recess;
- a vertical beam which is detachably connected to the horizontal beam and comprises a vertical beam slotted hole;
- a bracket which is detachably connected to the vertical beam;
- a rack which is connected to the bracket; and
- a position-limiting piece and a gasket which are integrally formed, wherein the position-limiting piece is connected to the bracket through the gasket and is configured to impede a position change of the rack relative to the bracket.

Compared with the prior art, a shelving system provided in the present application has the following technical effects:

1. by setting a position-limiting piece, position changes of a rack relative to a bracket and of the bracket relative to a vertical beam are reduced, and the stability of the shelving system is improved;
2. by connecting a gasket to a lug of the bracket, the strength of a joint between the bracket and the vertical beam is enhanced, so that the bracket is not prone to be deformed and damaged, and at the same time, the movable space of the bracket relative to the vertical beam in a horizontal direction is reduced, thus improving the stability;
3. by providing a raised rib above the lug, the sliding of the bracket relative to the vertical beam in a vertical direction can be prevented, thus improving the stability;
4. by providing two different matching grooves at both ends of the vertical beam, it is possible to simultaneously match the two most common horizontal beams of different specifications in the prior art; and
5. by providing an avoiding groove and an avoiding portion on the vertical beam, the vertical beam can be easily slid along the horizontal beam without interference with screws.

Hereinafter, the concept, specific structure and technical effects of the present application will be further illustrated in conjunction with the accompanying drawings, so as to fully understand the purposes, features and effects of the present application.

1—horizontal beam, 10—connecting nail, 101—first row of connecting nails, 102—second row of connecting nails, 11—horizontal beam recess, 12—horizontal beam protrusion, 2—vertical beam, 21—vertical beam slotted hole, 22—first matching groove, 23—second matching groove, 24—vertical beam avoiding groove, 25—vertical beam avoiding portion, 26—vertical beam bending portion, 27—first wall of vertical beam, 28—second wall of vertical beam, 29—third wall of vertical beam, 3—bracket, 31—upper edge of bracket, 32—lug, 321—first slot, 34—receiving groove, 37—hole, 38—hole, 39—cam shaft hole, 310—bracket wall, 311—bracket bottom, 312—first retaining groove, 313—second retaining groove, 314—fastening surface, 315—fastening hole, 4—rack, 401—end portion, 41—transverse metal wire, 42—longitudinal metal wire, 44—frame, 441—connecting metal wire, 45—bottom, 5—position-limiting piece, 51—gasket, 510—connecting portion, 512—hole, 513—hole, 514—second slot, 52—retaining rib, 53—raised rib, 54—pressing portion, 55—cam shaft, 56—receiving space, 520—gasket, 521—end portion, 522—base, 523—engaging portion, 524—engaging groove.

DETAILED DESCRIPTION OF THE PREFERRED EMBODIMENTS

Hereinafter, a plurality of preferred embodiments of the present application will be introduced with reference to the drawings attached to the specification, so that the technical content will be clearer and easier to understand. The present application can be embodied in many different forms of embodiments, and the scope of protection of the present application is not limited to the embodiments mentioned herein.

Figure 1:
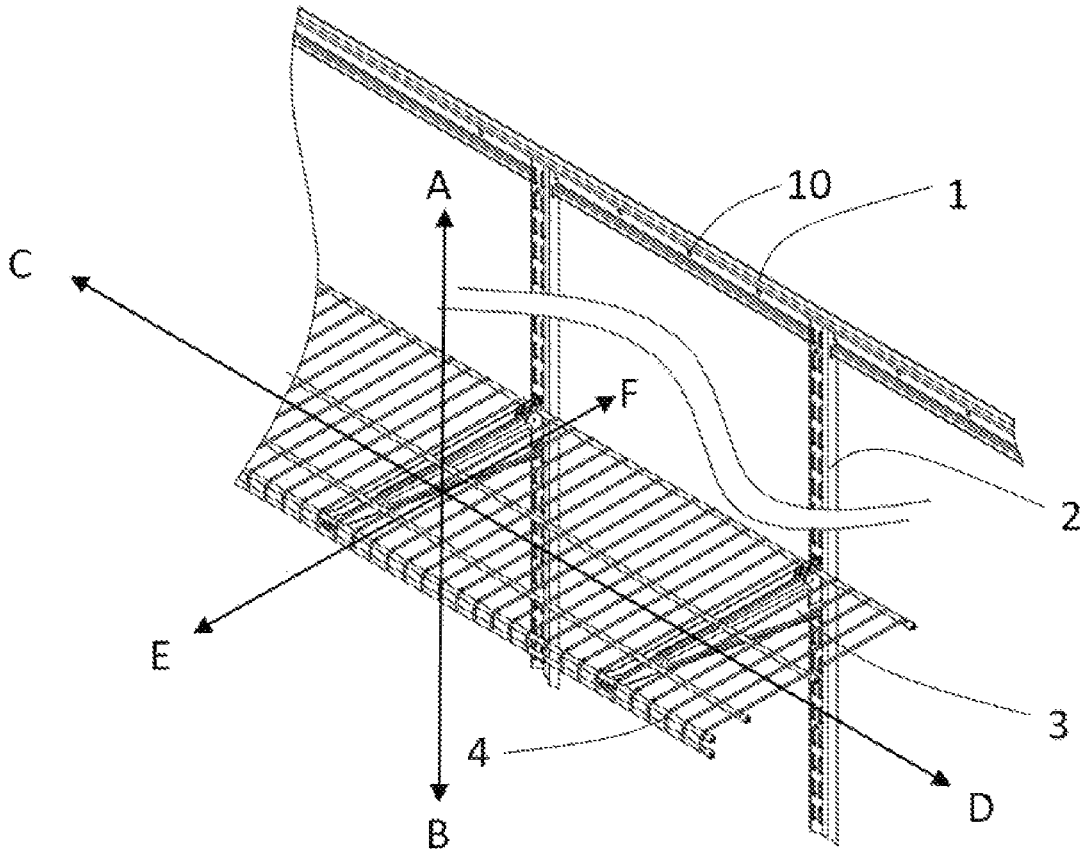
FIG. 1 is a schematic view of an overall structure in Embodiment 1 of the present application.

In the drawings, components with the same structure are represented by the same numerals, and components with similar structures or functions are represented by similar numerals. The size and thickness of each component shown in the drawings are arbitrarily shown, and the size and thickness of each component are not limited in the present application. In order to make the illustration clearer, the thicknesses of the components are appropriately exaggerated in some places in the drawings. As shown in FIG. 1, in the present application, "vertical directions" are same as or opposite to a natural gravity direction, i.e., directions indicated by arrows A and B in FIG. 1; and "horizontal directions" are natural horizontal directions. Directions indicated by arrows C, D, E, and F in the figure are all the "horizontal directions". In the horizontal directions, "transverse" refers to directions parallel to the horizontal beam, that is, the directions indicated by the arrows C and D in the figure. In the horizontal directions, "longitudinal" refers to directions perpendicular to the "transverse", that is, the directions indicated by the arrows E and F in the figure. For brackets and racks, a direction pointing toward a vertical beam is a "tail direction", that is, the direction indicated by the arrow F in the figure, and a direction pointing away from the vertical beam is a "head direction", that is, the direction indicated by the arrow E in the figure. When the vertical beam is installed vertically, the size of a vertical beam slotted hole in a vertical direction is a "length" and the size thereof in a horizontal direction is a "width". Sizes of a lug, a gasket and a raised rib in a vertical direction are "lengths", and sizes thereof in a horizontal direction are "thicknesses".

Embodiment 1

Figure 2:
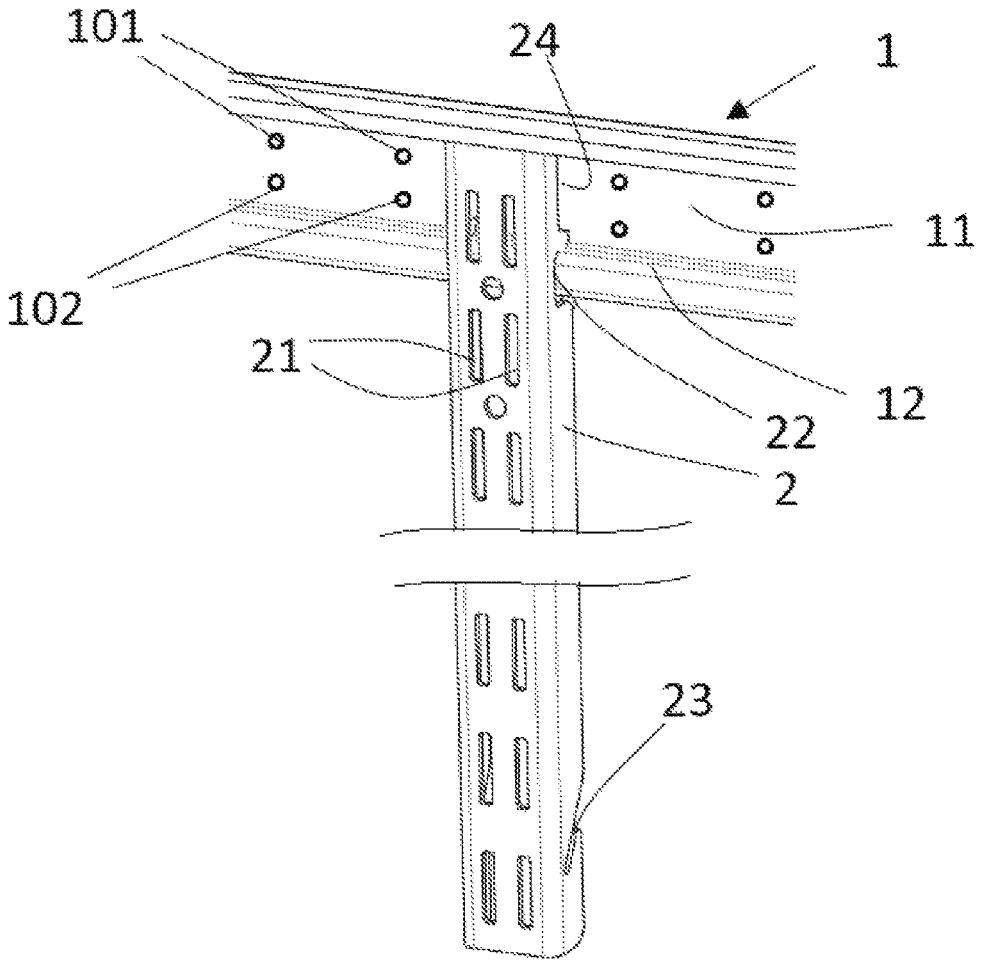
FIG. 2 is a partial enlarged schematic view of FIG. 1, showing a connection structure between a vertical beam and a horizontal beam.
Figure 3:
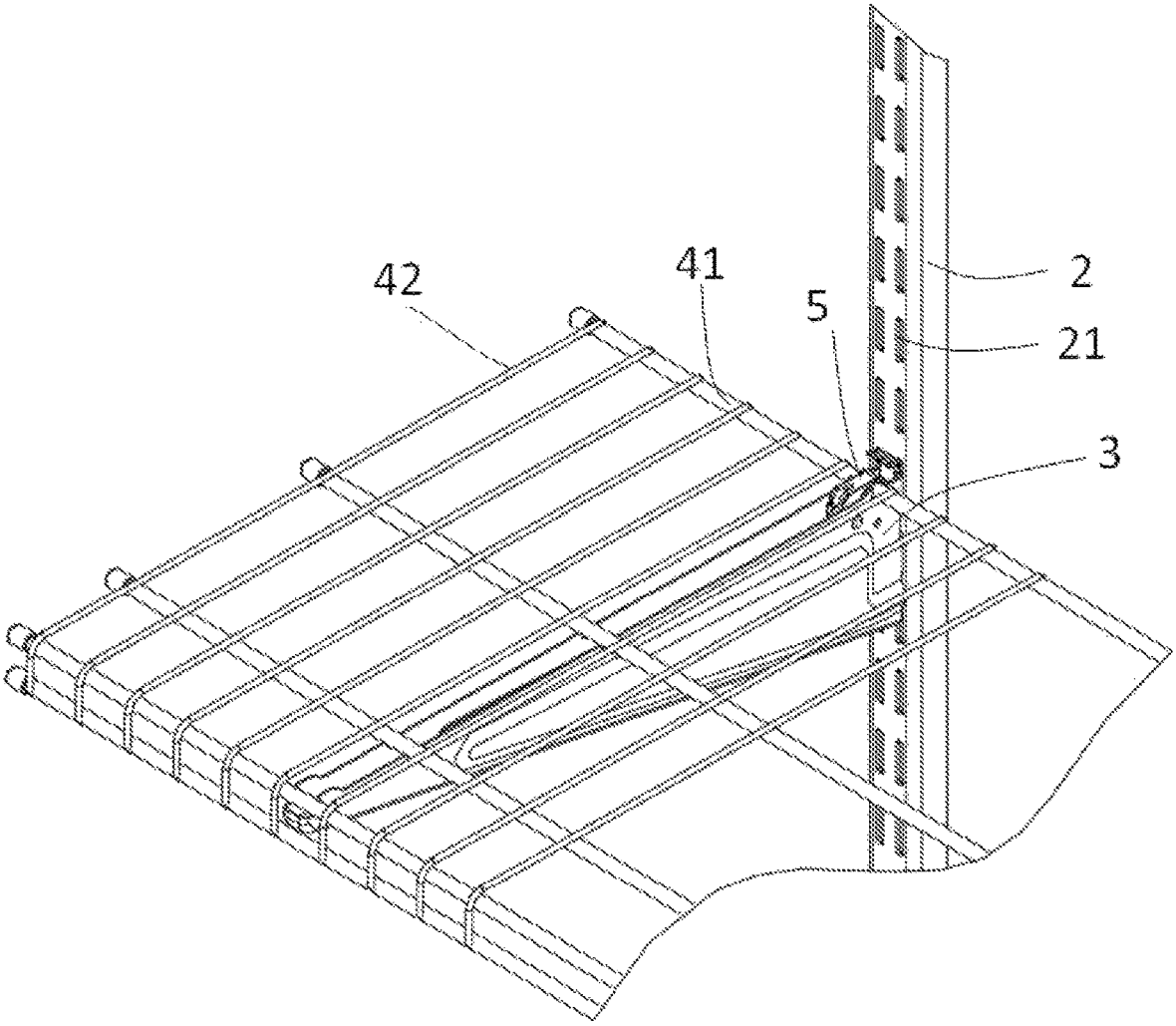
FIG. 3 is an enlarged schematic view of a connecting part between a bracket and a vertical beam in Embodiment 1 of the present application.
Figure 4:
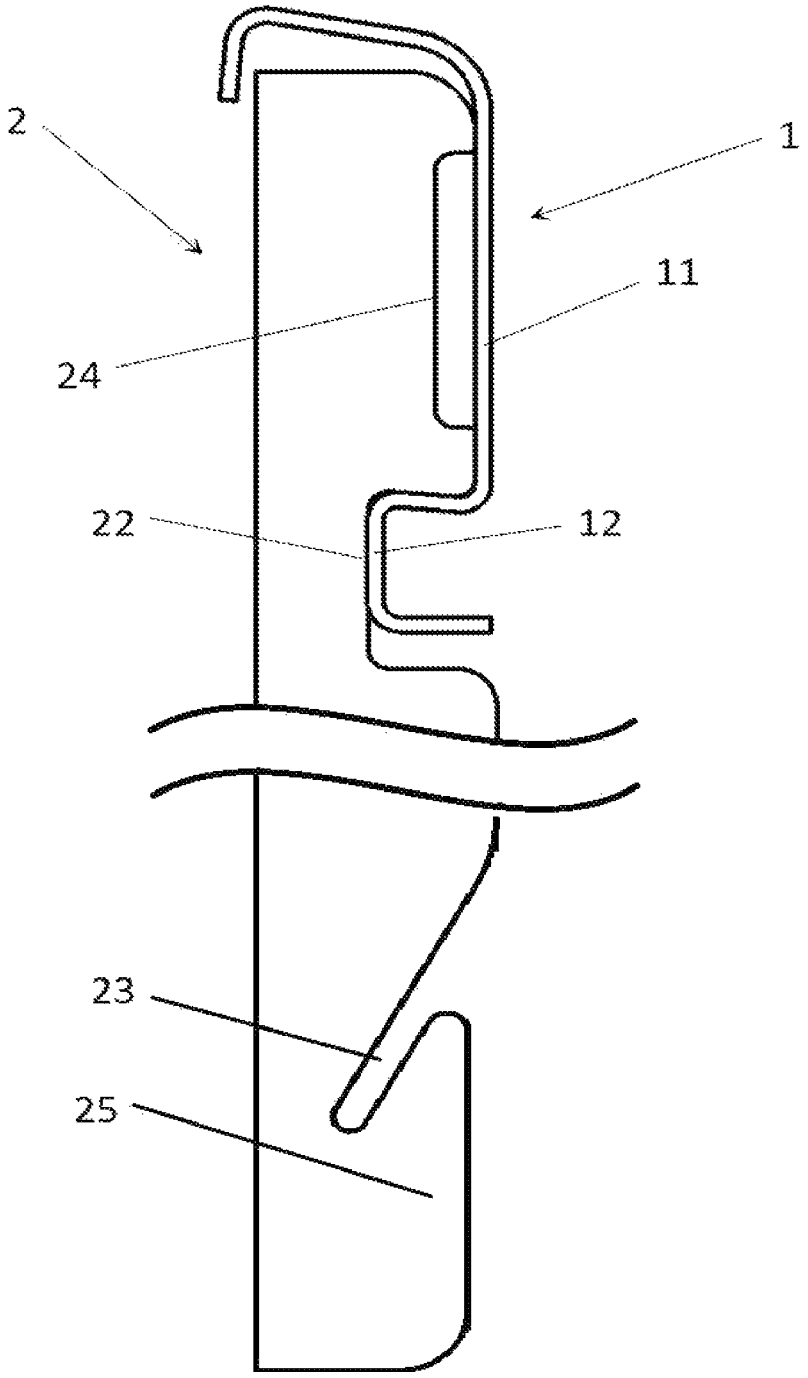
FIG. 4 is a side cross-sectional view of a connecting part between a vertical beam and a horizontal beam of the present application.

The overall structure of a shelving system provided in this embodiment is shown in FIGS. 1, 2 and 3. FIGS. 2 and 3 are partial enlarged views of FIG. 1. The shelving system comprises a horizontal beam 1, a vertical beam 2, a bracket 3, and a rack 4. The horizontal beam 1 is usually fixed, by screws, to a vertical surface, such as a wall surface or a board surface. The horizontal beam 1 usually uses standard pieces in the prior art and is in a long strip shape. The side cross-sectional view of a connecting part between the horizontal beam 1 and the vertical beam 2 is shown in FIG. 4. The horizontal beam 1 comprises a horizontal beam recess 11 and a horizontal beam protrusion 12. In use, the horizontal beam recess 11 is attached to the vertical surface, and is connected to the vertical surface by connecting nails such as screws and rivets. The vertical beam 2 is fitted with the horizontal beam protrusion 12 through the first matching groove 22 to realize the sliding of the vertical beam 2 in a transverse direction. Two common shapes of the horizontal beam protrusion 12 comprise a rectangular horizontal beam protrusion 12 and a wedge-shaped horizontal beam protrusion 12. Correspondingly, the shape of the first matching groove 22 provided on the vertical beam 2 can also be configured as a flat opening (fitted with the rectangular horizontal beam protrusion 12) or an oblique opening (fitted with the wedge-shaped horizontal beam protrusion 12). In the prior art, each vertical beam 2 is provided with only one matching groove, so each vertical beam 2 can only be fitted with a certain type of horizontal beam 1. In fact, the horizontal beam 1 is fixed on the vertical surface, and once it is fixed, it does not move easily. The structure change of the shelving system is mainly carried out by adding, reducing, and moving the vertical beam 2, so the vertical beam 2 is detachable and movable. In this embodiment, preferably as shown in FIG. 2, the vertical beam 2 is provided with the first matching groove 22 and a second matching groove 23. The first matching groove 22 has a flat opening shape, and the second matching groove 23 has an oblique opening shape, such that the vertical beam 2 can be fitted with any one of the two common horizontal beams 1. Therefore, in the shelving system provided in this embodiment, the horizontal beam 1 can use any one of the two most commonly used standard pieces or a combination of the two, without affecting the disassembly and assembly of the vertical beam 2. A plurality of vertical beam slotted holes 21 are provided on the vertical beam 2. One end of the bracket 3 is detachably connected to the vertical beam 2 through the vertical beam slotted holes 21. The grid-like rack 4 is provided on the bracket 3.

In order to solve the problem of the load-bearing capacity of the entire shelving system, the first step should be to increase the bonding force between the horizontal beam 1 and the vertical surface. In the prior art, connecting nails 10 are usually used to fixedly connect the horizontal beam recess 11 to the vertical surface, and the connecting nails 10 for fixing are arranged along the length direction of the horizontal beam 1 to form a row. The main factor that can affect the bonding force between the horizontal beam 1 and the vertical surface is the bonding force between the connecting nails 10 and the vertical surface. However, under normal circumstances, the bonding force between the connecting nails 10 and the vertical surface is affected by the material of the vertical surface and cannot be easily changed. Therefore, in this embodiment, a solution of multiple rows of connecting nails 10 is adopted. As shown in FIG. 2, along the length direction of the horizontal beam 1, a first row of connecting nails 101 and a second row of connecting nails 102 are provided, and the first row of connecting nails 101 and the second row of connecting nails 102 are arranged in parallel. The first row of connecting nails 101 are provided above the second row of connecting nails 102. In other similar embodiments, more rows of connecting nails can also be provided, or the up-and-down positional relationship between the rows of connecting nails can be set as needed to further increase the bonding force between the horizontal beam 1 and the vertical surface. In order to receive more connecting nails 10 in the vertical direction, the length of the horizontal beam recess 11 in this embodiment is longer than that of the horizontal beam recess 11 commonly seen in the prior art.

In addition, due to the existence of the connecting nails 10, the horizontal beam recess 11 is inevitably uneven. Even if a space for receiving the connecting nails 10 is provided on the horizontal beam recess 11, in some cases, the connecting nails 10 cannot be installed smoothly, which may still cause the horizontal beam recess 11 to be uneven. Therefore, when the vertical beam 2 slides along the length direction of the horizontal beam 1, it is easy to cause interference between the vertical beam 2 and the connecting nails 10. Therefore, in the vertical beam 2 used in this embodiment, when the first matching groove 22 of the flat opening is connected to the rectangular horizontal beam protrusion 12 in a fitted manner, a vertical beam avoiding groove 24 is also provided at a position corresponding to the connecting nails 10. When the second matching groove 23 of the oblique opening is connected to the wedge-shaped horizontal beam protrusion 12 in a fitted manner, a vertical beam avoiding portion 25 is provided at a position corresponding to the connecting nails 10. The vertical beam avoiding portion 25 is formed by retracting the vertical beam 2 toward the head by a predetermined distance, which can also achieve the technical effect of avoiding interference between the vertical beam 2 and the connecting nails 10.

Figure 5:
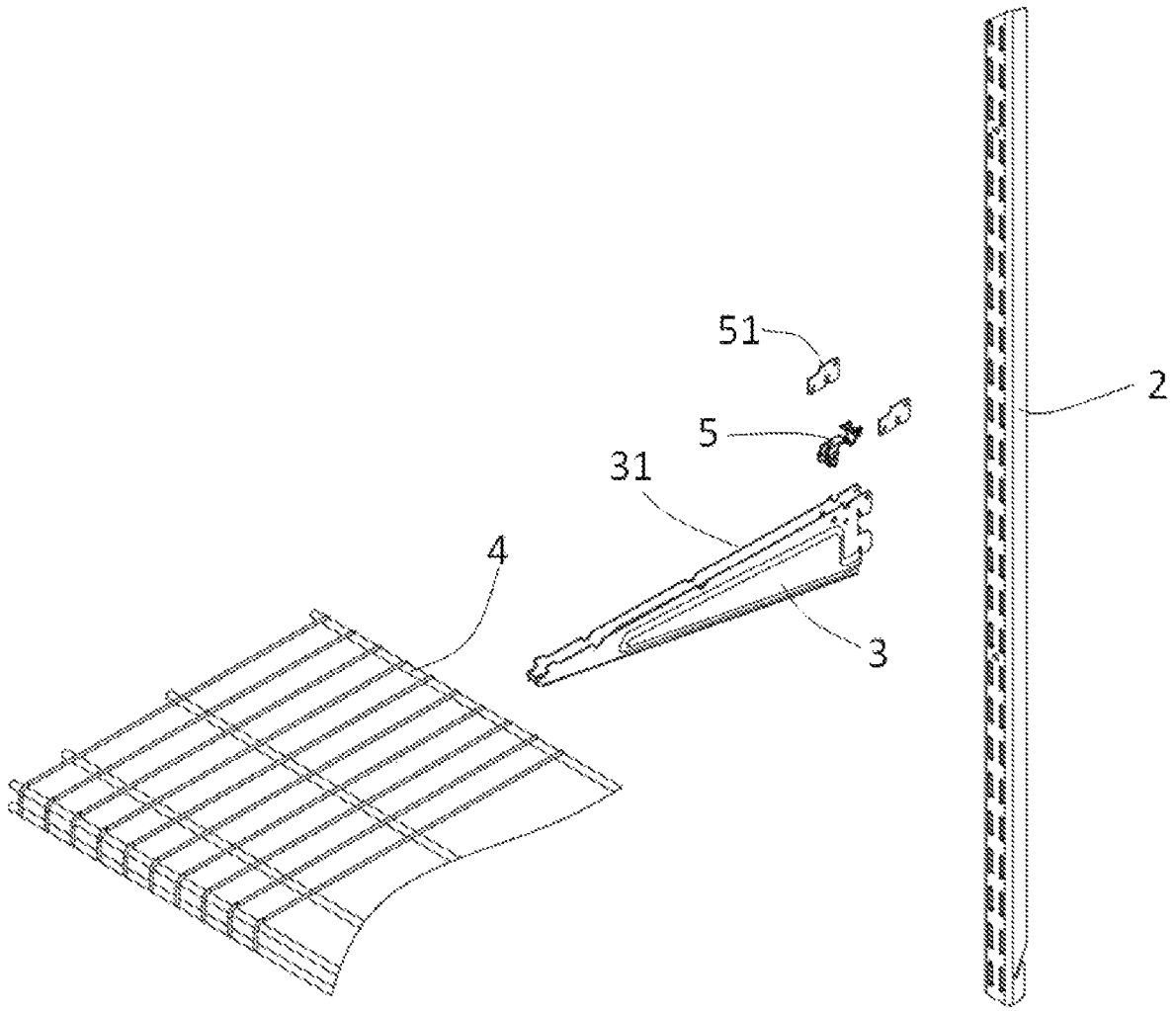
FIG. 5 is an exploded schematic view of a connecting part between a bracket and a vertical beam in Embodiment 1 of the present application.
Figure 6:
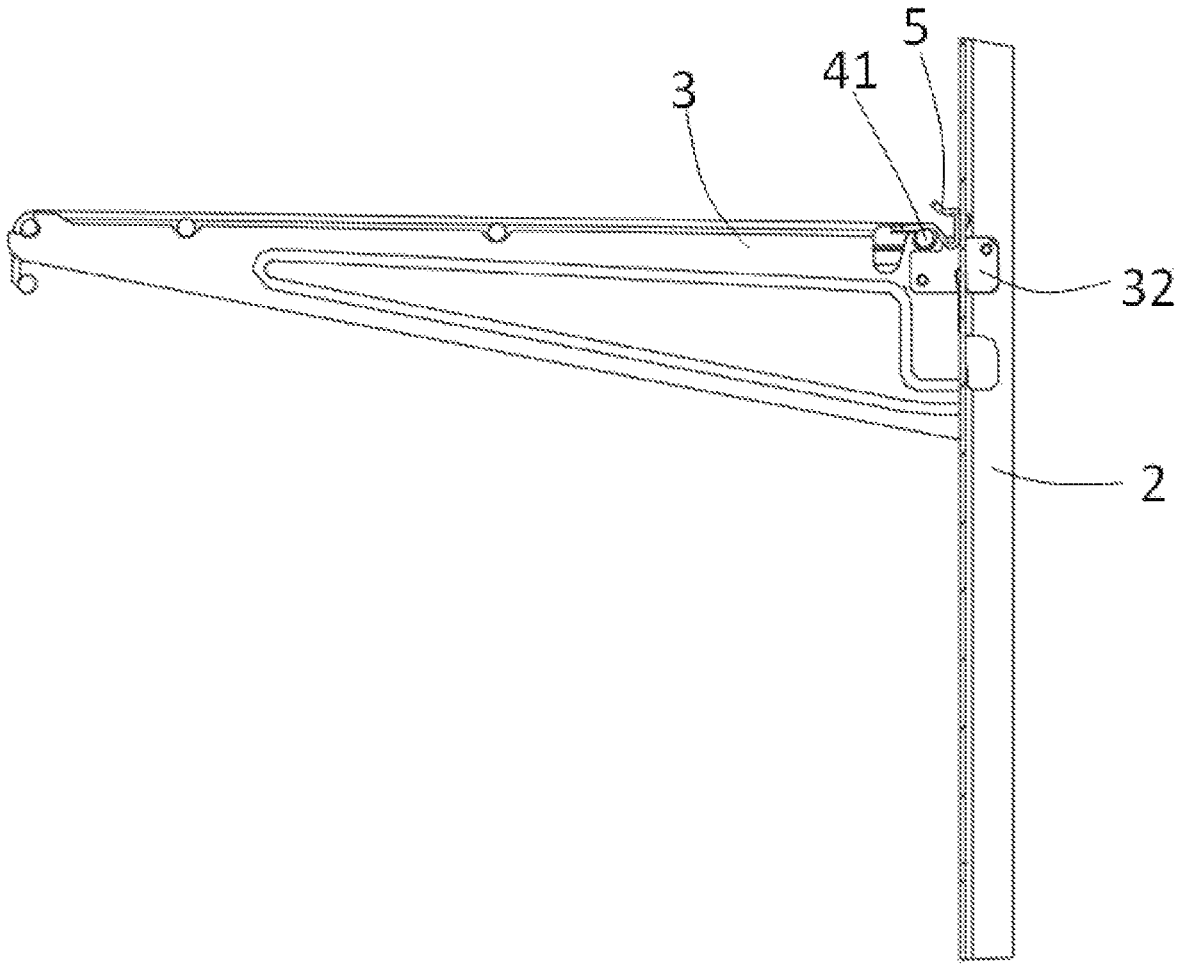
FIG. 6 is a side cross-sectional view of a bracket in Embodiment 1 of the present application.
Figure 7:
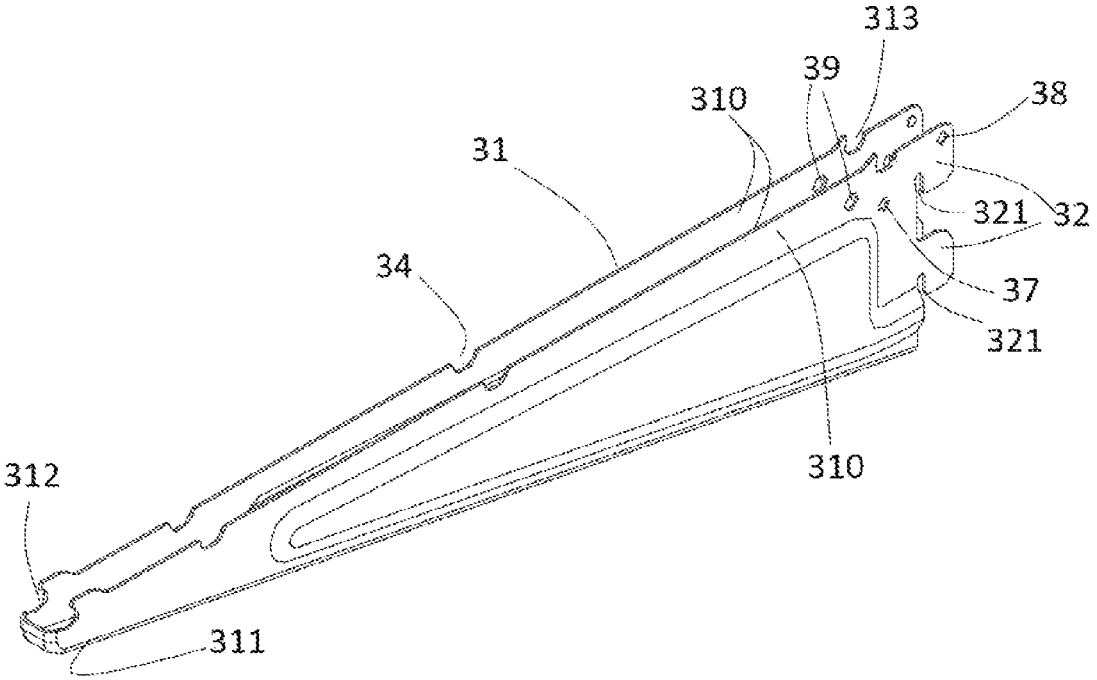
FIG. 7 is a schematic structural view of a bracket in Embodiment 1 of the present application.

The bracket 3 and the connection relationship between the bracket 3 and the vertical beam 2 are shown in FIGS. 5-7. As shown in FIG. 7, the side cross section of the bracket 3 is substantially triangular, and it is composed of two bracket walls 310 that are provided substantially in parallel and a bracket bottom 311. Lugs 32 are provided at positions where the bracket 3 and the vertical beam 2 are connected. The lugs 32 are specifically protruding parts from one end of the bracket walls 310, and first slots 321 are provided between the lugs 32 and the bracket walls 310. The lugs 32 can be inserted into the vertical beam slotted holes 21, and then the bracket 3 is moved down, such that the edges of the vertical beam slotted holes 21 are stuck into the first slots 321 of the lugs 32, so that the bracket 3 is detachably connected to the vertical beam 2 in a hanging manner. In other similar embodiments, the bracket 3 may also comprise only one bracket wall 310. Preferably, each bracket wall 310 is provided with two sets of upper and lower lugs 32, which are respectively inserted into the upper and lower two vertical beam slotted holes 21, that is, for each bracket 3, a total of four lugs 32 are respectively inserted into four vertical beam slotted holes 21.

In the relationship of the shelving system, one of the main factors affecting the load-bearing capacity of the shelving system is the strength of the vertical beam 2. A top cross-sectional view of a vertical beam 2 that can be used in this embodiment is shown in part A in FIG. 8. The vertical beam comprises a first wall 27 of the vertical beam and two second walls 28 of the vertical beam. The two second walls 28 of the vertical beam are provided at both ends of the first wall 27 of the vertical beam. The first wall 27 of the vertical beam and the second walls 28 of the vertical beam are connected by vertical beam bending portions 26, such that the first wall 27 of the vertical beam and the second walls 28 of the vertical beam form a certain angle, preferably 90 degrees. Preferably, the first wall 27 of the vertical beam and the second walls 28 of the vertical beam are formed by bending the same sheet-like metal material twice. The thickness b of the metal material is the wall thickness b of the first wall 27 of the vertical beam and the second walls 28 of the vertical beam. In the prior art, the length a of the first wall 27 of the vertical beam is 25 mm, and the wall thickness b is 1.8 mm. In order to enhance the strength of the vertical beam 2, the method that can be adopted is to increase the length a of the first wall 27 of the vertical beam, or increase the wall thickness b. However, it is not arbitrary to enhance the strength of the vertical beam 2 in this way. On one hand, it will increase the material consumption and cost. On the other hand, arbitrarily increasing the length a and the wall thickness b of the first wall 27 of the vertical beam does not necessarily have the technical effect of enhancing the strength of the vertical beam 2. After research, in this embodiment, the length a of the first wall of the vertical beam is set to 28 mm, and the wall thickness b is set to 1.8 mm. Under the condition that the vertical beam 2 bears the same force, the stress can be reduced by about 34%, such that the vertical beam 2 can bear greater force.

Figure 8:
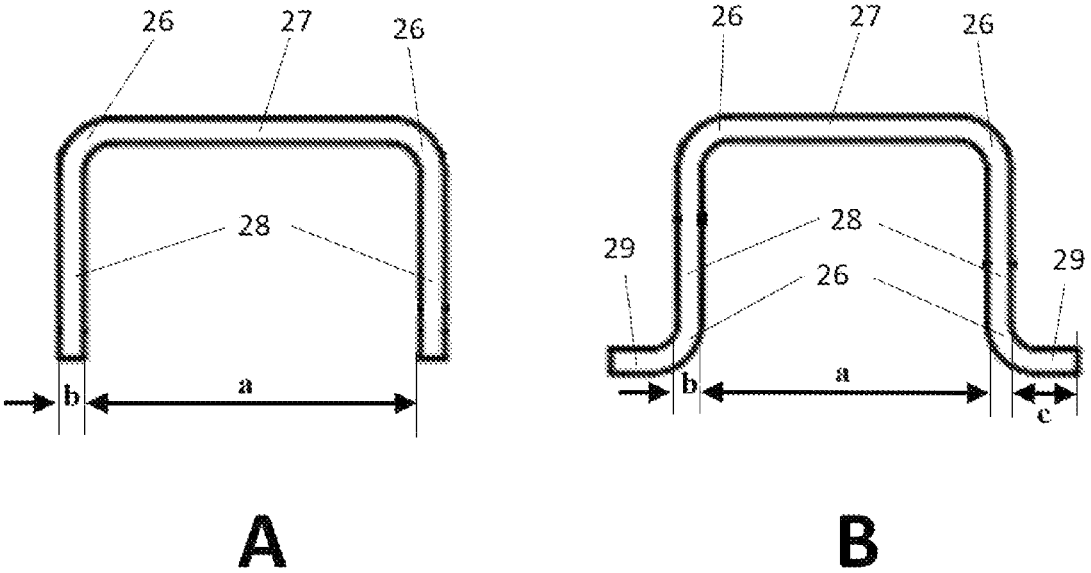
FIG. 8 is a schematic section view of a vertical beam in Embodiment 1 of the present application.

A top cross-sectional view of another vertical beam 2 that can be used in this embodiment is shown in part B in FIG. 8. The vertical beam comprises a first wall 27 of the vertical beam, two second walls 28 of the vertical beam, and two third walls 29 of the vertical beam. Each of the two ends of the first wall 27 of the vertical beam is provided with a second wall 28 of the vertical beam and a third wall 29 of the vertical beam. The first wall 27 of the vertical beam and the second walls 28 of the vertical beam are connected by vertical beam bending portions 26, such that the first wall 27 of the vertical beam and the second walls 28 of the vertical beam form a certain angle, preferably 90 degrees. The second walls 28 of the vertical beam and the third walls 29 of the vertical beam are connected by vertical beam bending portions 26, such that the second walls 28 of the vertical beam and the third walls 29 of the vertical beam form a certain angle, preferably 90 degrees. Preferably, the first wall 27 of the vertical beam, the second walls 28 of the vertical beam, and the third walls 29 of the vertical beam are formed by bending the same sheet-like metal material four times. The thickness b of the metal material is the wall thickness b of the first wall 27 of the vertical beam, the second walls 28 of the vertical beam and the third walls 29 of the vertical beam. The length a of the first wall 27 of the vertical beam may be 25 mm or 28 mm, the wall thickness b may be 1.8 mm, and the length c of the third wall 29 of the vertical beam may be 5 mm.

Figure 9:
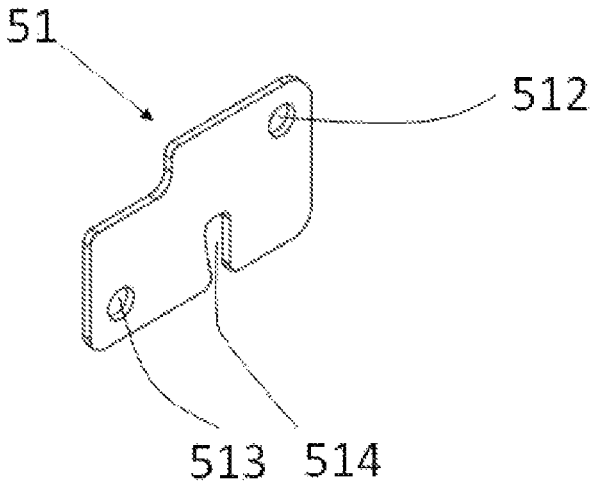
FIG. 9 is a schematic structural view of a gasket in Embodiment 1 of the present application.

In the connection relationship of the shelving system, the main factor affecting the load-bearing capacity of the shelving system also comprises the strength of the lugs 32. After research, it is found that in the prior art in a bracket that fails due to its load exceeding an upper limit, the failure position is often at a lug 32, especially a lug 32 at an upper position, because in the entire structure, the greatest stress will be generated at the lug 32 at the upper position. Therefore, in this embodiment, a gasket 51 is provided at the lug 32 at the upper position, and the gasket 51 is attached to the lug 32, and can be provided on either side or both sides of the lug 32. Specifically, as shown in FIG. 9, the gasket 51 has a shape similar to that of the lug 32, and the gasket 51 has a second slot 514. When the gasket 51 is connected to the lug 32, the position of the second slot 514 is substantially the same as that of the first slot 321, both of which can be stuck into the vertical beam slotted hole 21 at its edge. The gasket 51 and the lug 32 can be fixedly connected by welding or riveting, or can be connected by screws or rivets. When screws or rivets are used to connect the gasket 51 and the lug 32, a hole 37 and a hole 38 are provided near the position of the lug 32, and corresponding holes 513 and 512 are provided at corresponding positions on the gasket 51. The screws or rivets are sequentially passed through the holes on the gasket 51 and the holes at the corresponding positions of the lug, to achieve a fixed connection. The lug 32 with the gasket 51 is equivalent to being locally thickened, thereby increasing the strength. Preferably, the gaskets 51 are provided only at the two lugs 32 located at the upper positions of the bracket 3, which significantly increases the strength of the weakest part, but at the same time, the structure and weight of the entire bracket 3 hardly change, the process difficulty is also not increased, and the cost is hardly affected.

In the connection relationship of the shelving system, the main factor affecting the load-bearing capacity of the shelving system also comprises the stability of the bracket 3 relative to the vertical beam 2. In the prior art, after the lug 32 is inserted into the vertical beam slotted hole 21, a certain gap is left between the lug 32 and the edge of the vertical beam slotted hole 21, so that the bracket 3 has a movable space in the transverse direction relative to the vertical beam 2, which affects the stability of the bracket 3. The gasket 51 makes the position of the lug 32 locally thicker, which not only improves the strength of the lug 32, but also makes the gap between the lug 32 and the vertical beam slotted hole 21 smaller, that is, the movable space of the bracket 3 relative to the vertical beam 2 in the transverse direction is reduced, which increases the stability of the bracket 3. It should be understood that, in some embodiments, a gasket 51 may also be provided at a lug 32 at the bottom of the bracket wall 310 to increase the strength of the lug 32 and the stability of the bracket 3.

Figure 10:
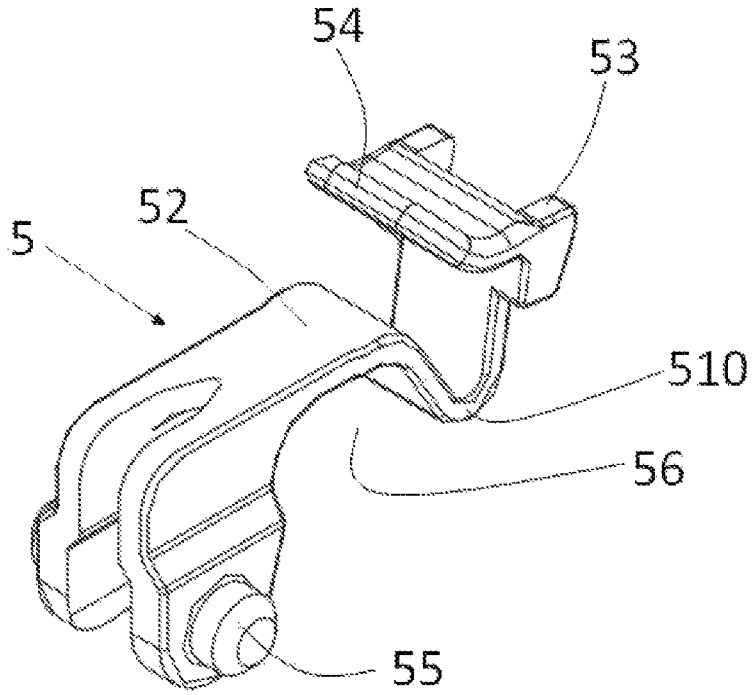
FIG. 10 is a schematic structural view of a position-limiting piece in Embodiment 1 of the present application.

Additionally, in the prior art, in order to ensure that the lug 32 can move down after being inserted into the vertical beam slotted hole 21 so that the edge of the vertical beam slotted hole 21 is stuck into the first slot 321 of the lug 32, the length of the vertical beam slotted hole 21 should be greater than the length of the lug 32. This makes that after the bracket 3 is installed on the vertical beam 2, there is a movable space in the vertical direction. When a user accidentally hits the lower edge of the bracket 3, it may even cause the bracket 3 to fall off the vertical beam 2, resulting in the failure of the entire shelving system. Therefore, in this embodiment, as shown in FIG. 10, two raised ribs 53 are provided on a position-limiting piece 5. The two raised ribs 53 are respectively located on both sides of the position-limiting piece 5 and located on one end of the position-limiting piece 5 close to the vertical beam 2. After the lugs 32 of the bracket 3 are inserted into the vertical beam slotted holes 21 and moved downward to be stuck, the two raised ribs 53 can also be inserted into the vertical beam slotted holes 21. At this time, the unfilled spaces of the vertical beam slotted holes 21 due to the downward movements of the lugs 32 in the vertical direction are at least partially filled by the raised ribs 53. Due to the elasticity of the position-limiting piece 5, the raised ribs 53 are subjected to the forces of the upper edges of the vertical beam slotted holes 21, and then the forces can be transmitted to the bracket 3 through a curved connecting portion 510 between the raised ribs 53 and a retaining rib 52. Therefore, the movable space of the bracket 3 relative to the vertical beam 2 is reduced to a certain extent. Even if the bracket 3 is accidentally subjected to an upward impact or force, it will not cause the lugs 32 to move upward and cause the bracket 3 to fall off the vertical beam 2. A pressing portion 54 is also provided at the top position of the raised ribs 53. During installation, the pressing portion 54 is pressed to make the position-limiting piece 5 slightly deformed, and then the raised ribs 53 are inserted into the vertical beam slotted holes 21. At this time, the pressing portion 54 is released, and the position-limiting piece 5 can be used to press the raised ribs 53 in the vertical beam slotted holes 21 due to its own elasticity. If the position-limiting piece 5 needs to be taken out, the pressing portion 54 can be pressed to release the pressing portion 54 after the raised ribs 53 are disengaged from the vertical beam slotted holes 21.

In the connection relationship of the shelving system, the main factor affecting the load-bearing capacity of the shelving system also comprises the stability of the rack 4 relative to the bracket 3. The grid-like rack 4 is provided on the bracket 3. The rack 4 is composed of a plurality of transverse metal wires 41 arranged in parallel and a plurality of longitudinal metal wires 42 arranged in parallel. Specifically, the transverse metal wires 41 are arranged under the longitudinal metal wires 42 and are interwoven into a mesh structure. In the prior art, receiving grooves 34, first retaining grooves 312, and second retaining grooves 313 are provided on the upper edge of the bracket 3, and the first retaining grooves 312 and the second retaining grooves 313 are both arc-shaped semi-enclosed structures. The first retaining grooves 312 are provided at the head of the bracket 3, and the second retaining grooves 313 are provided at the tail of the bracket. The opening directions of the first retaining grooves 312 are toward the head and diagonally upward, and the opening directions of the second retaining grooves 313 are toward the tail and diagonally upward. When a transverse metal wire 42 of the rack 4 is received in the first retaining grooves 312 and is in contact with the bottoms of the first retaining grooves 312, the rack 4 cannot move toward the tail due to a position-limiting effect of the first retaining grooves 312. When a transverse metal wire 42 of the rack 4 is received in the second retaining grooves 313 and is in contact with the bottoms of the second retaining grooves 313, the rack 4 cannot move toward the head due to a position-limiting effect of the second retaining grooves 313. With a position-limiting effect of the receiving grooves 34, it can be realized that the rack 4 cannot move freely in the horizontal direction. However, on one hand, the position-limiting effects of the first retaining grooves 312 and the second retaining grooves 313 on the rack 4 in the vertical direction are very limited; on the other hand, in practical applications, since it is inevitable that there will be a size matching error between the rack 4 and the bracket 3, it is usually difficult for the two transverse metal wires 42 of the rack 4 to simultaneously contact the bottoms of the first retaining grooves 312 and the second retaining grooves 313 at the same time, which further weakens the position-limiting effects of the first retaining grooves 312 and the second retaining grooves 313 on the rack 4 in the vertical direction. When subjected to an upward force, the rack 4 is easily disengaged from the bracket 3, thus causing the failure of the entire shelving system. Therefore, in this embodiment, the position-limiting piece 5 is provided to impede a position change of the rack 4 relative to the bracket 3 in the vertical direction. The position-limiting piece 5 comprises the retaining rib 52, and the retaining rib 52 forms a receiving space 56 for receiving a part of the rack 4. In this embodiment, as shown in FIG. 10, the retaining rib 52 is in an arch shape, such that a receiving space 56 is formed under the retaining rib 52. The receiving space 56 can receive a metal wire of the rack 4, as shown in FIG. 6, for example. A transverse metal wire 41 of the rack 4 is located in the receiving space 56. The position-limiting piece 5 may have elasticity, thereby being able to exert a pretension force acting on the rack 4 to further restrict the movement of the rack 4 in various directions, especially the vertical direction.

As shown in FIG. 10, in order to facilitate the assembly and disassembly of the position-limiting piece 5, the position-limiting piece 5 used in this embodiment further comprises two cam shafts 55, and the two cam shafts 55 are located on the position-limiting piece 5 at one end away from the vertical beam 2. The sizes of the cam shafts 55 are equivalent to the sizes of cam shaft holes 39 on the bracket 3. The position-limiting piece 5 is made of a material with certain elasticity, such as plastic or metal. By pressing the positions of the cam shafts 55 from both sides to the middle, the position-limiting piece 5 can be locally deformed, and the relative distance between the two cam shafts 55 is reduced, such that the two cam shafts 55 can enter between the two bracket walls 310 of the bracket 3 and get stuck into the cam shaft holes 39, and finally the position-limiting piece 5 and the bracket 3 are rotatably connected.

Embodiment 2

Figure 11:
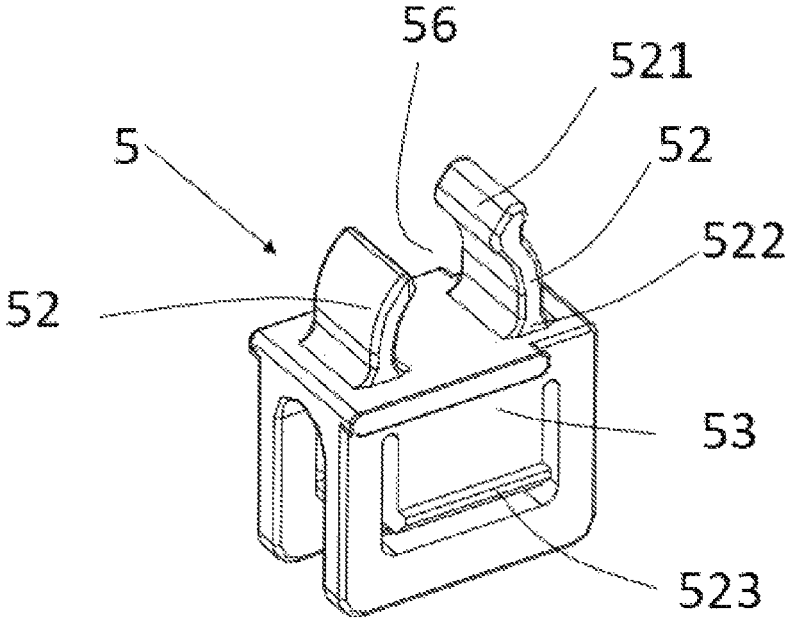
FIG. 11 is a schematic structural view of a position-limiting piece in Embodiment 2 of the present application.
Figure 12:
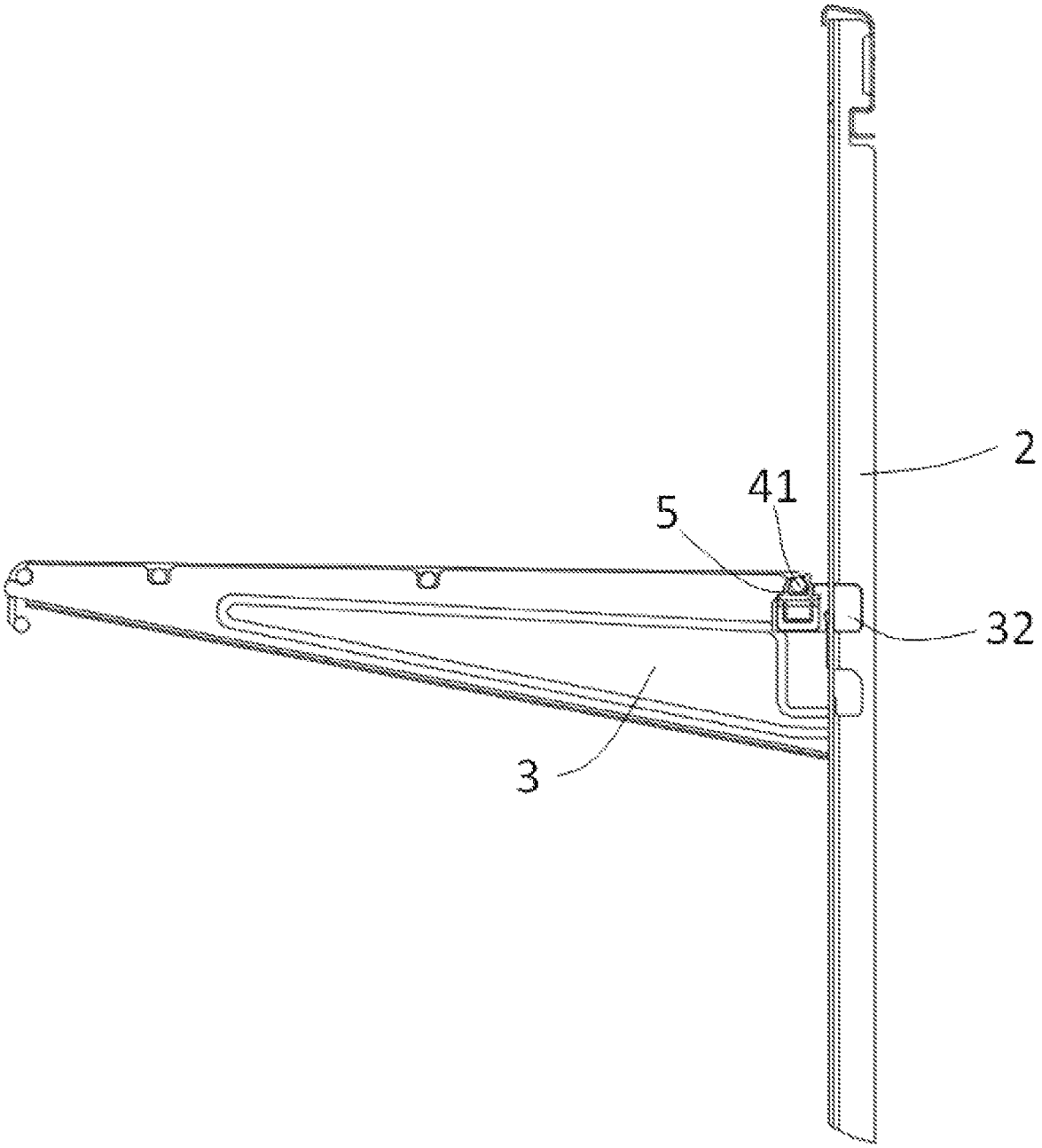
FIG. 12 is a side cross-sectional view of a bracket in Embodiment 2 of the present application.
Figure 13:
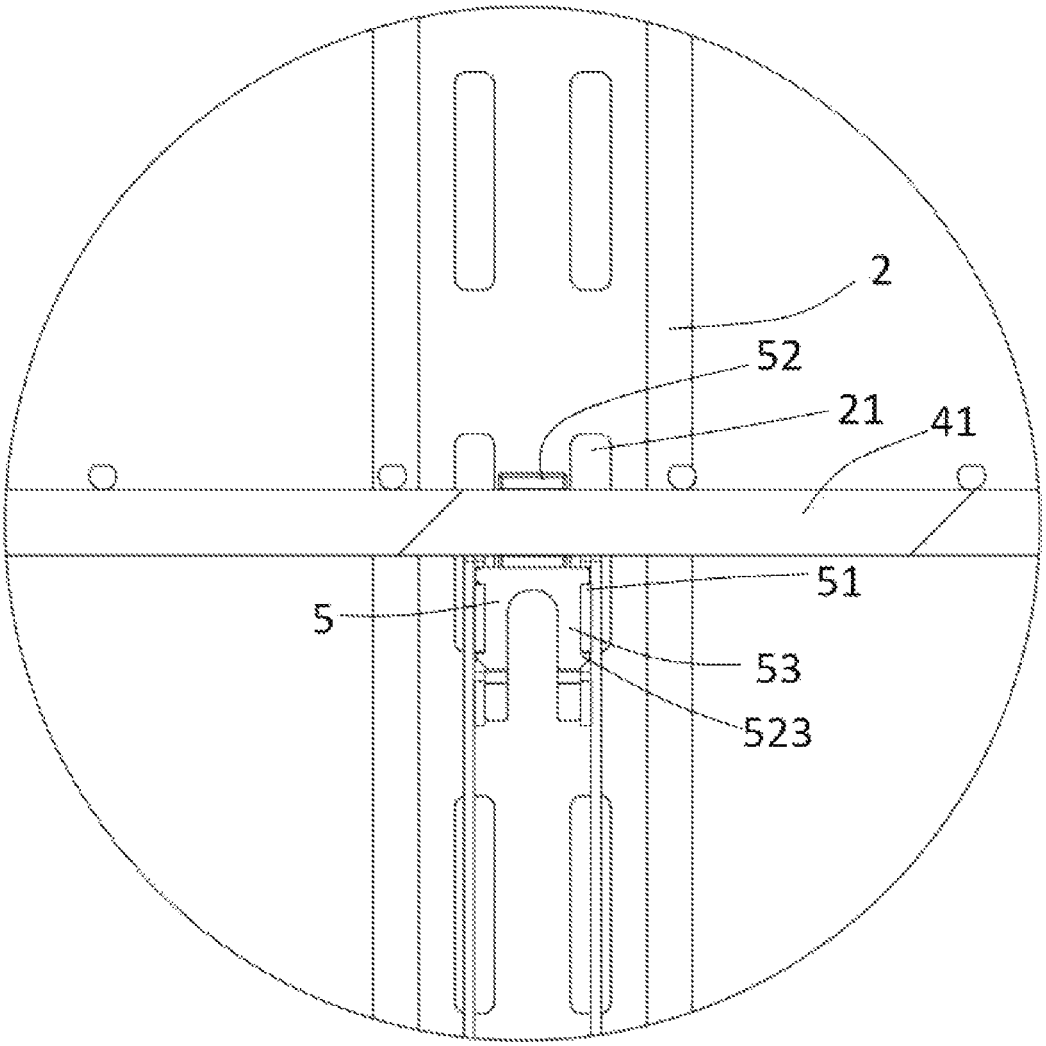
FIG. 13 is a partial enlarged schematic view of fitting of a position-limiting piece and a bracket in Embodiment 2 of the present application.

The shelving system provided in this embodiment is shown in FIGS. 11-13.

The structure of the vertical beam, the structure of the horizontal beam, the connection mode between the vertical beam and the horizontal beam, the structure of the bracket, and the structure of the rack in this embodiment are the same as those in Embodiment 1, and will not be repeated here. The difference between this embodiment and Embodiment 1 is that a position-limiting piece 5 used in this embodiment is shown in FIG. 11. The position-limiting piece 5 is also made of an elastic material, and comprises a retaining rib 52 on the top and raised ribs 53 on the sides. The retaining rib 52 has an arc-shaped two-petal shape. Each petal of the two-petal retaining rib 52 comprises an end portion 521 and a base 522, wherein the base 522 is used to connect the retaining rib 52 and the position-limiting piece 5, and the end portion 521 is provided at an end of the retaining rib 52 away from the base. The two petals of the retaining rib 52 are close to each other at the end portions 521 to form a substantially semi-enclosed structure together and form a receiving space 56 for receiving a part of the rack 4. The receiving space 56 is a substantially semi-circular or circular space. The raised ribs 53 are located on both sides of the position-limiting piece 5 and under the retaining rib 52. The raised ribs 53 are provided with engaging portions 523. The sizes of the engaging portions 523 match the sizes of engaging grooves 524 provided at corresponding positions of gaskets 51. In addition, the outer surface of the engaging portion 523 is a wedge-shaped slope, which is narrow at the bottom and wide at the top. After two gaskets 51 are fixedly connected to the inner sides of the bracket walls 310 of the bracket 3 by screwing, welding or riveting, the position-limiting piece 5 is pressed into a space between the two gaskets 51 from top to bottom. At the same time, the engaging portions 523 on the two raised ribs 53 are stuck into the engaging grooves 524 at the corresponding positions on the gaskets 51 to realize the engagement of the position-limiting piece 5 and the bracket 3, as shown in FIGS. 12 and 13. In order to increase the stability of the rack 4 on the bracket 3, the receiving space 56 formed by enclosing the two petals of the retaining rib 52 is used for receiving the transverse metal wire 41. The two-petal retaining rib 52 has certain elasticity, and the distance between upper ends of the two petals is slightly less than the diameter of the transverse metal wire 41. When the rack 4 is installed, the transverse metal wire 41 at the corresponding position is pressed downward into the middle of the two-petal retaining rib 52, and under the action of the transverse metal wire 41, the two-petal retaining rib 52 is expanded, that is, the distance between the upper ends of the two petals of the retaining rib 52 is increased, which is convenient for the transverse metal wire 41 to enter the receiving space 56. When the widest part of the transverse metal wire 41 passes through the upper end of the retaining rib 52, the two-petal retaining rib 52 automatically closes due to elasticity. In the receiving space 56, the two petals of the retaining rib 52 can both generate transverse forces on the transverse metal wire 41, and the forces are opposite in direction, so as to reduce the movable space of the transverse metal wire 41 in the transverse direction. At the same time, the two petals of the retaining rib 52 can also generate vertical forces on the transverse metal wire 41 to a certain extent, so as to prevent the rack 4 from being disengaged from the bracket 3 when subjected to an upward force.

Embodiment 3

Figure 14:
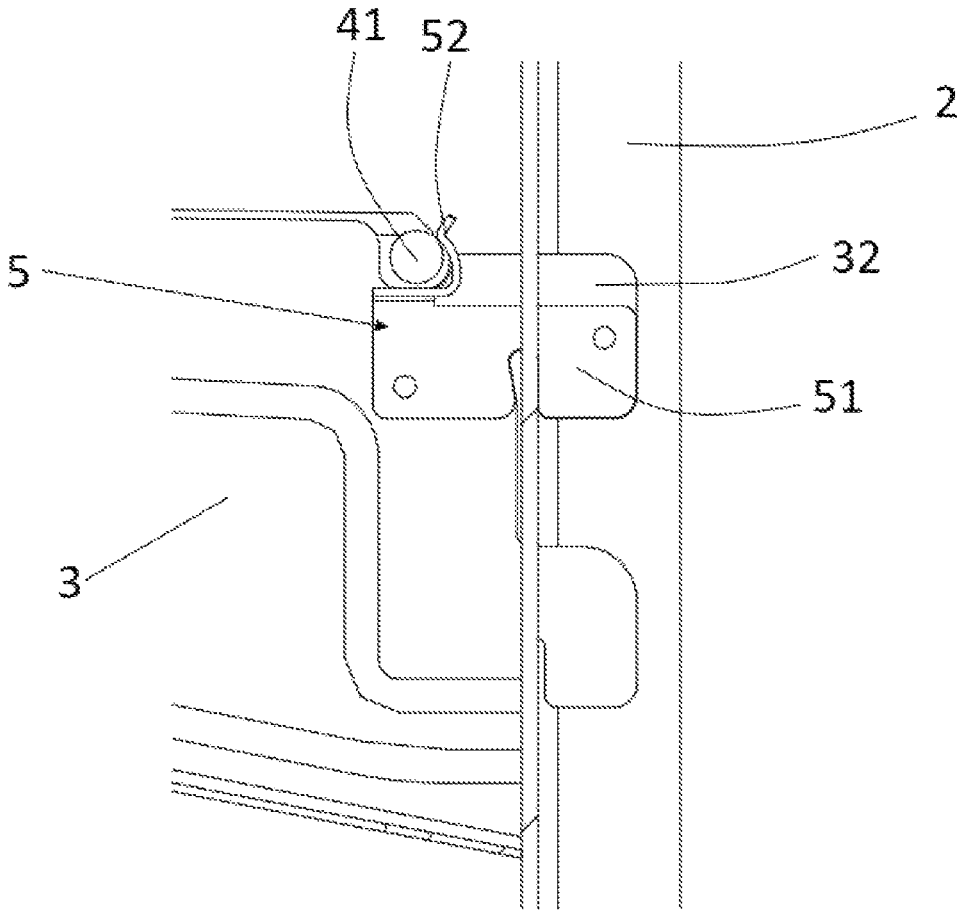
FIG. 14 is a side cross-sectional view of a bracket in Embodiment 3 of the present application.
Figure 15:
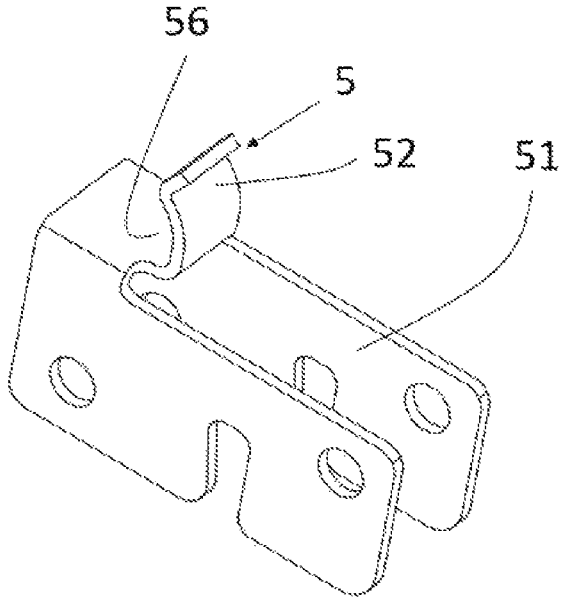
FIG. 15 is a schematic structural view of a position-limiting piece in Embodiment 3 of the present application.
Figure 16:
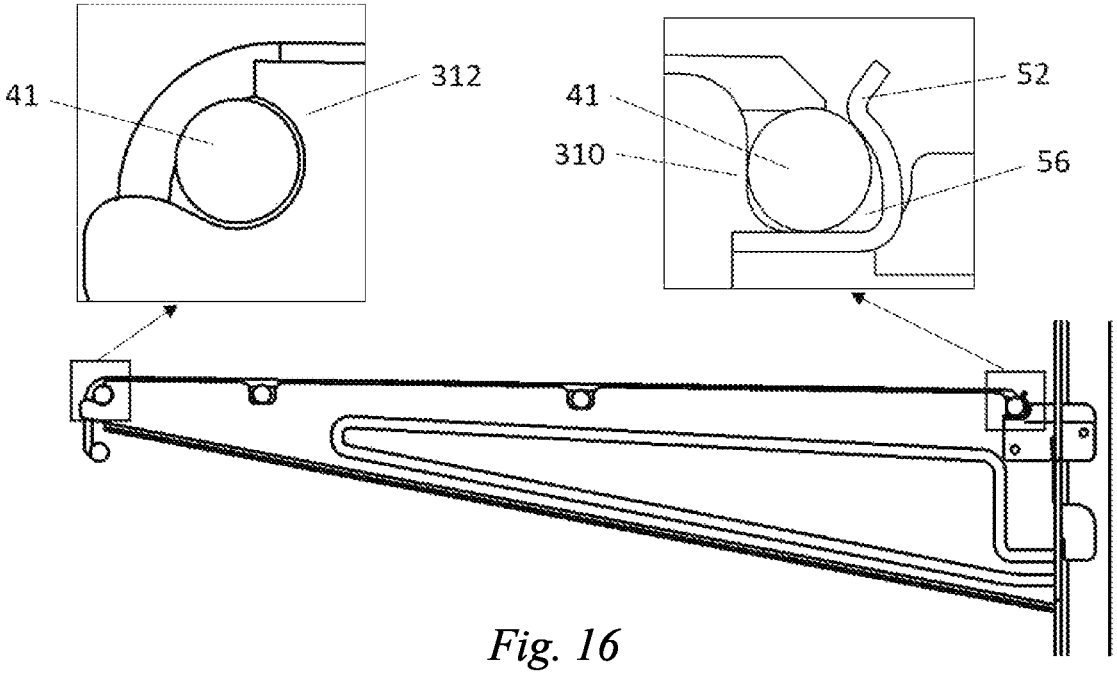
FIG. 16 is a schematic view of a manner in which a position-limiting piece defines a position of a rack in Embodiment 3 of the present application.

The shelving system provided in this embodiment is shown in FIGS. 14-16. The structure of the vertical beam, the structure of the horizontal beam, the connection mode between the vertical beam and the horizontal beam, the structure of the bracket, and the structure of the rack in this embodiment are the same as those in Embodiment 1, and will not be repeated here. The difference between this embodiment and Embodiment 1 and Embodiment 2 is that a position-limiting piece 5 used in this embodiment is shown in FIG. 15. The position-limiting piece 5 and gaskets 51 are integrally formed and do not need to be connected by structural design. Specifically, the position-limiting piece 5 comprises two gaskets 51 and a curved retaining rib 52. The two gaskets 51 are provided substantially parallel to each other, and are fixedly connected by the tail of the retaining rib 52. The gasket 51 has a shape similar to that of a lug 32. Holes of the same size are provided at corresponding positions on the lug 32 and the gasket 51. The gasket 51 and the lug 32 can be fixedly connected by screws through the corresponding holes, and other fixing methods such as welding and riveting can also be used. It should be understood that when welding, riveting and other similar fixing methods are used, there is no need to provide holes on the lug 32 and the gasket 51. The position-limiting piece 5 is also made of a metal or plastic material with certain elasticity. The retaining rib 52 is arc-shaped, and the arc-shaped part thereof encloses a receiving space 56. After the position-limiting piece 5 is fixedly connected to a bracket 3, the receiving space 56 where the curved retaining rib 52 is located can be used to receive a transverse metal wire 41, as shown in FIG. 14. Specifically, an external force is exerted to toggle the retaining rib 52 so that the radius of curvature of the arc where the retaining rib 52 is located becomes larger, and the receiving space 56 inside the arc becomes larger, so that the transverse metal wire 41 can enter the receiving space 56 where the retaining rib 52 is located. After being released, the retaining rib 52 returns to its original shape due to elasticity, that is, the radius of curvature of the arc where the retaining rib 52 is located becomes smaller, and the receiving space 56 inside the arc becomes smaller, so that the transverse metal wire 41 is limited in the retaining rib 52.

The position-limiting method on the rack 4 in this embodiment is shown in FIG. 16. The head of the bracket 3 is provided with first retaining grooves 312 same as those in Embodiment 1. When a transverse metal wire 41 is received in the first retaining grooves 312 and is in contact with the bottoms of the first retaining grooves 312, the rack 4 cannot move toward the tail relative to the bracket 3 due to a position-limiting effect of the first retaining grooves 312. When the transverse metal wire 41 is received in the receiving space 56 of the retaining rib 52, due to the elasticity of the retaining rib 52, the transverse metal wire 41 is also in contact with bracket walls 310 at the same time. The retaining rib 52 and the bracket walls 310 simultaneously exert horizontal and vertical forces on the transverse metal wire, which prevents the transverse metal wire 41 from moving in all directions, especially upwards along the vertical direction, thereby increasing the stability of the rack 4 relative to the bracket 3.

It should be understood that the position arrangement of the position-limiting piece 5 and the rack 4 provided in this embodiment can also be implemented in Embodiments 1 and 2, and is not limited to this embodiment.

Embodiment 4

Figure 17:
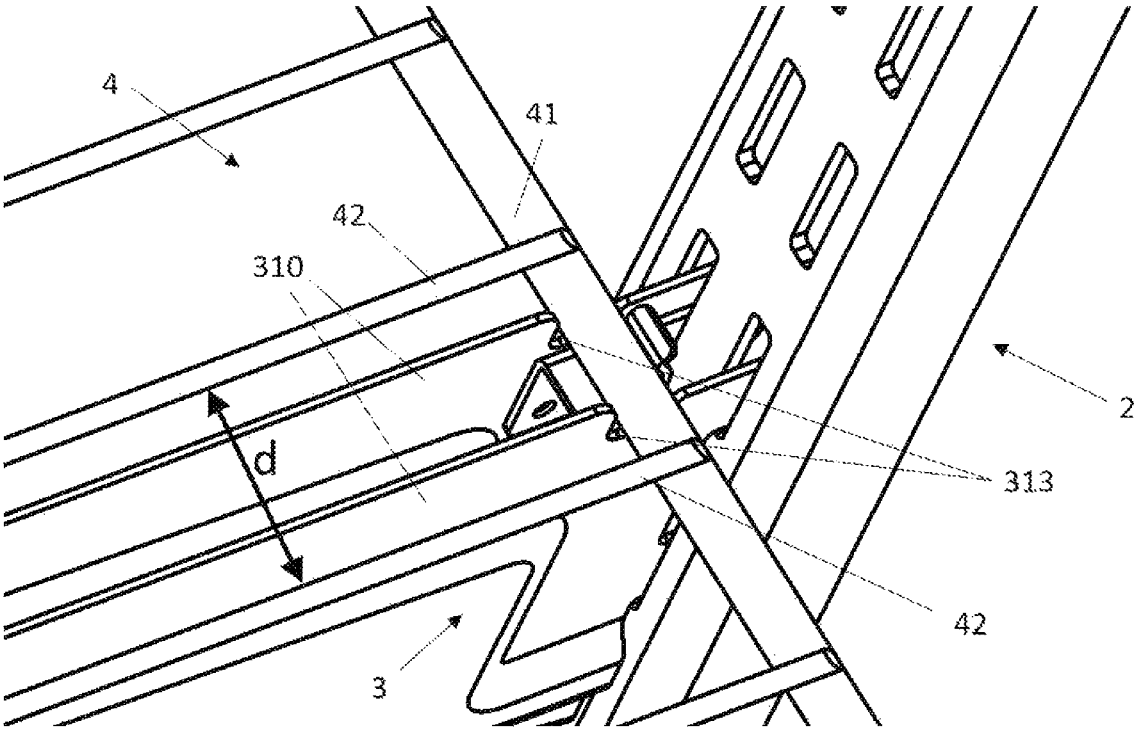
FIG. 17 is a partial enlarged schematic view of a connection position between a rack 4 and a bracket 3 in Embodiment 4 of the present application.

As shown in FIG. 17, in the prior art, when a transverse metal wire 41 of a rack 4 is received in second retaining grooves 313, or is received in first retaining grooves 312 or receiving grooves 34 (as shown in FIG. 7), two bracket walls 310 of a bracket 3 are located between two adjacent longitudinal metal wires 42. When the rack 4 moves transversely relative to the bracket 3 for a certain distance, the bracket walls 310 can block the longitudinal metal wire 42 so that the rack 4 cannot continue to move. However, since the current common spacing d between adjacent longitudinal metal wires 42 is 1 inch, which is significantly greater than the spacing between the two bracket walls 310, the rack 4 has a larger movable space in the transverse direction relative to the bracket 3 in fact. Thus, the stability of the shelving system is affected. Therefore, in this embodiment, the spacing d between adjacent longitudinal metal wires 42 is reduced. Preferably, the spacing d is set to ⅝ inch. In other similar embodiments, the spacing d can also be set to other values, as long as it is not less than the spacing between the two bracket walls 310. On one hand, reducing the spacing d can reduce the movable space of the rack 4 relative to the bracket 3 in the transverse direction; on the other hand, the rack 4 with a smaller spacing d can carry an item of smaller volume, so that the item will not fall from a position between two longitudinal metal wires 42; even if some items are large in volume and they will not fall from a position between the two longitudinal metal wires 42, the rack 4 with the smaller spacing d can make parts (such as feet and bases), which have smaller volumes, of the items not easily stuck between the longitudinal metal wires 42.

Figure 18:
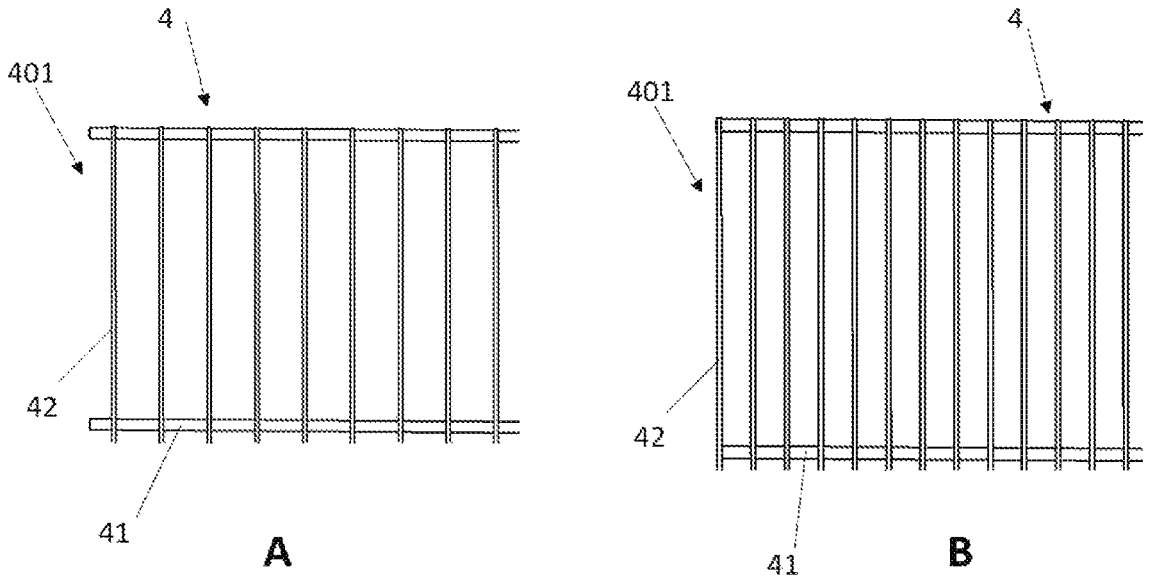
FIG. 18 is a schematic structural view of a rack 4 in Embodiment 4 of the present application.
Figure 19:
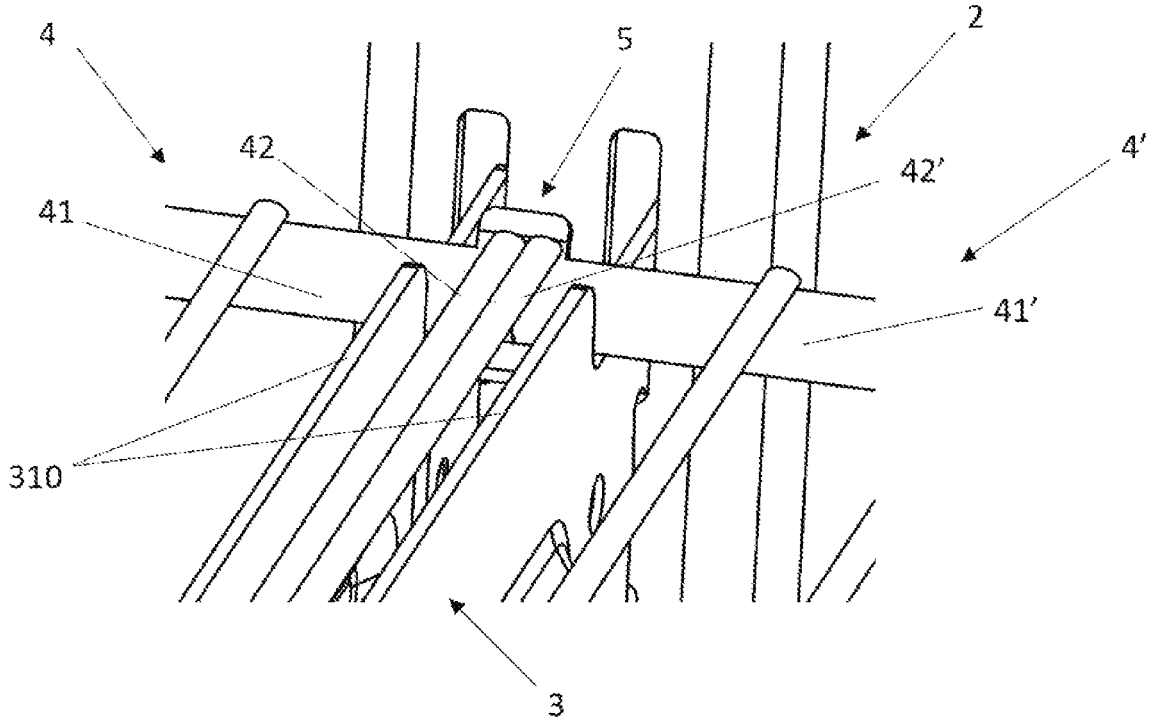
FIG. 19 is a partial enlarged schematic view of a splicing position of a rack 4 in Embodiment 4 of the present application.

The structure of a rack 4 used in the prior art is shown in part A of FIG. 18, and the structure of a rack 4 used in this embodiment is shown in part B of FIG. 18. In the prior art, at an end portion 401 of the rack 4, the transverse metal wire 41 protrudes a certain length relative to the longitudinal metal wire 42 at the most edge. When the length of the shelving system is relatively long and multiple racks 4 need to be spliced, it is usually necessary to provide a special connecting mechanism to splice end portions 401 of the multiple racks 4. With respect to the rack 4 used in this embodiment, at the end portion 401, the end surface of the transverse metal wire 41 is flush with the longitudinal metal wire 42, so a splicing method as shown in FIG. 19 can be adopted. One rack 4 and another rack 4' are placed side by side, and transverse metal wires 41 and 41' near the tail, which belong to the two racks 4 and 4' respectively, are placed in alignment. Longitudinal metal wires 42 and 42' at the most edge, which belong to the two racks 4 and 4' respectively, are arranged parallel to each other and are in contact with each other, and the longitudinal metal wires 42 and 42' are both located between the two sides 310 of the bracket 3. The position-limiting piece 5 has a position-limiting effect on both the transverse metal wires 41 and 41'. In this embodiment, the bracket 3 also plays a role of splicing the racks 4 and 4', so there is no need to additionally provide a splicing mechanism, which makes the structure of the shelving system simpler and lower in cost.

Embodiment 5

Figure 20:
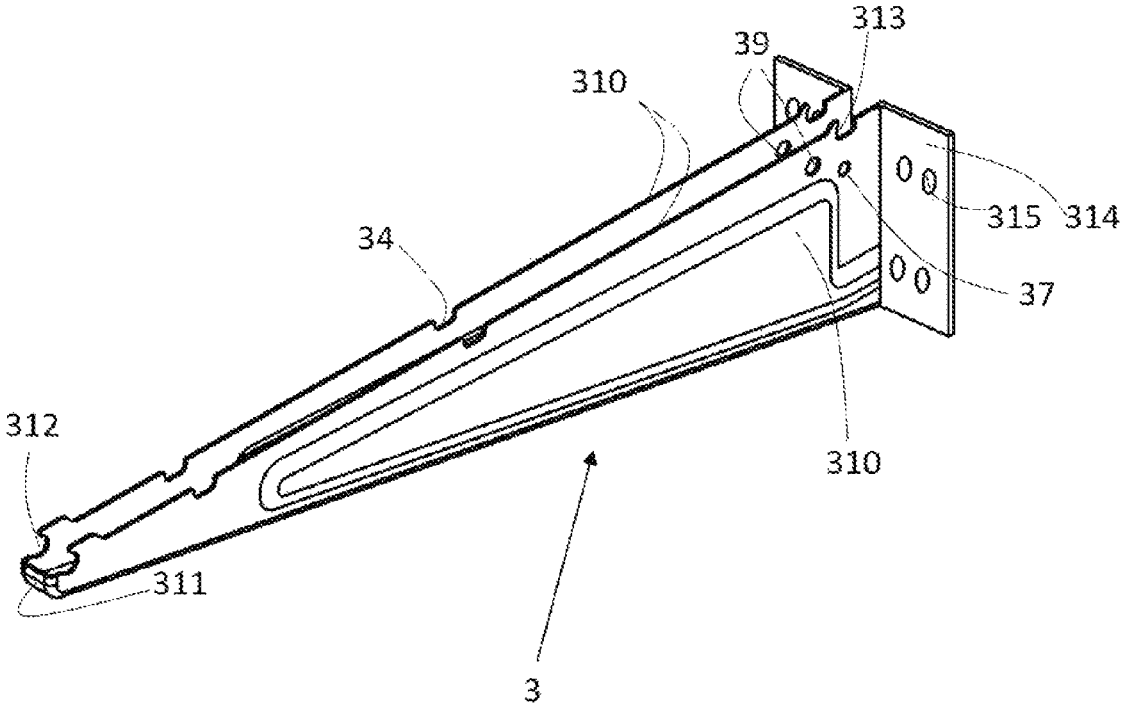
FIG. 20 is a schematic structural view of a bracket 3 in Embodiment 5 of the present application.

In some embodiments, the horizontal beam 1 and the vertical beam 2 are not required, and a connection mode in which a bracket 3 is directly fixed to a vertical surface is used. The bracket 3 used in this embodiment is shown in FIG. 20. Its structure is substantially the same as that of the bracket 3 in the foregoing embodiments. It also has two bracket walls 310 arranged in parallel, a bracket bottom 311, first retaining grooves 312, second retaining grooves 313, and receiving grooves 34. The difference from the foregoing embodiments is that the bracket 3 used in this embodiment is further provided with a fastening surface 314. The fastening surface 314 is provided at the tail of the bracket 3 and is connected to the tail of a bracket wall 310 for fixed connection with the vertical surface. When the bracket 3 is connected to the vertical surface, the fastening surface 314 is attached to the vertical surface. The fastening surface 314 can be fixedly connected to the vertical surface by bonding, or can be connected by screws or rivets. When the fastening surface 314 is connected to the vertical surface by screws or rivets, fastening holes 315 are provided at suitable positions of the fastening surface 314, and the fastening holes 315 are used to receive connecting nails. In this embodiment, the connecting nails may be screws or rivets, and the bracket 3 is fixedly connected to the vertical surface through the fastening holes 315. The number of fastening holes 315 can be selected according to actual needs. Preferably, a fastening surface 314 is provided at the tail of each of the two bracket walls 310 to improve the stability for fixing the bracket 3.

It should be understood that when it is necessary to install the position-limiting piece 5 as described in Embodiment 1 on the bracket 3 used in this embodiment, cam shaft holes 39 need to be provided at corresponding positions. When gaskets need to be installed with screws or rivets, holes 37 need to be provided at corresponding positions.

Embodiment 6

Figure 21:
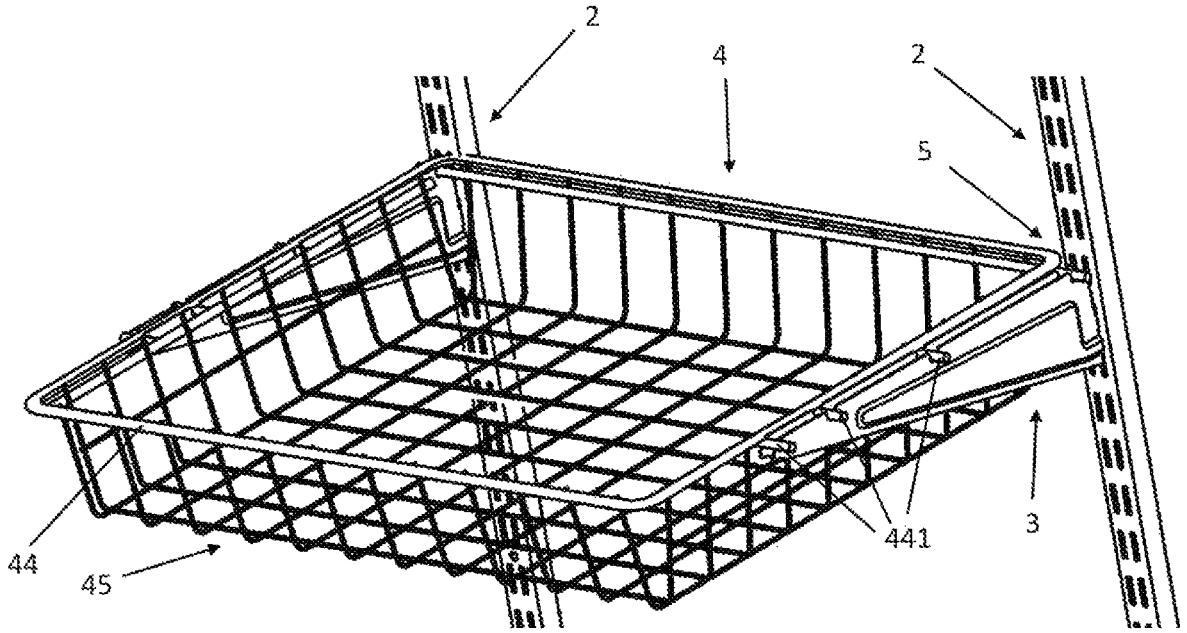
FIG. 21 is a schematic structural view of a shelving system in Embodiment 6 of the present application.

In some embodiments, a rack 4 may have a structure as shown in FIG. 21. In this embodiment, the rack 4 comprises a frame 44 and a bottom 45. Connecting metal wires 441 are provided at positions corresponding to the frame 44 and a bracket 3. When the bracket 3 shown in FIG. 7 is used in this embodiment, the connecting metal wires 441 are provided in corresponding positions of first retaining grooves 312, second retaining grooves 313, and receiving grooves 34. The bottom 45 is a recessed bearing portion. The frame 44 is provided on edges of the bottom 45 and is connected to the bottom 45 to form a basket-shaped rack 4. A horizontal beam 1, a vertical beam 2, the bracket 3, and a position-limiting piece 5 used in this embodiment can all adopt the structures described in the above embodiments.

It should be noted that the plurality of embodiments mentioned above only represent a few typical representatives of the present invention, but they should not be understood as a limitation on the scope of the invention patent. Other embodiments obtained through simple replacements and modifications fall within the scope of protection of the present invention. Various technical features of the above-mentioned embodiments can be combined arbitrarily. In order to make the description concise, all possible combinations of the various technical features in the above-mentioned embodiments are not described. However, as long as there is no contradiction in the combinations of these technical features, all of the combinations shall be considered to fall within the scope of the specification.

The preferred embodiments of the present application are described in detail above. It should be understood that those of ordinary skills in the art may make many modifications and changes according to the concept of the present application without creative work. Therefore, all technical solutions that can be obtained by those skilled in the art through logical analysis, reasoning or limited experiments based on the concept of the present application and the prior art should fall within the scope of protection defined by the claims.

The invention claimed is:

1. A shelving system, comprising a bracket, a rack and a vertical beam, wherein the vertical beam is connected to a vertical surface, the bracket is connected to the vertical beam, and the rack is provided on the bracket;

wherein the shelving system further comprises a position-limiting piece, wherein the position-limiting piece is provided at a joint between the bracket and the vertical beam, the position-limiting piece is connected to the bracket, the rack and the vertical beam, and the position-limiting piece is configured to impede a position change of the bracket relative to the vertical beam and to impede a position change of the rack relative to the bracket;

wherein the bracket comprises a bracket wall, and the bracket wall comprises a cam shaft hole;

wherein the position-limiting piece comprises a cam shaft, and the cam shaft is fitted with the cam shaft hole, so as to realize a rotational connection between the position-limiting piece and the bracket;

wherein the vertical beam comprises a vertical beam slotted hole;

wherein one end of the position-limiting piece is provided with a raised rib and a pressing portion, the raised rib is configured to be inserted into the vertical beam slotted hole and be subjected to a force of an upper edge of the vertical beam slotted hole, to reduce a movable space of the bracket relative to the vertical beam;

wherein the pressing portion is connected to the raised rib and is configured to be able to drive the raised rib to move toward or away from the upper edge of the vertical beam slotted hole under the action of an external force, thereby enabling the position-limiting piece to be connected to or disconnected from the vertical beam;

wherein the position-limiting piece comprises a retaining rib configured to receive a transverse metal wire of the rack, and a curved connecting portion is provided between the raised rib and the retaining rib;

wherein the retaining rib is in an arch shape, and a receiving space is formed under the retaining rib to receive the transverse metal wire of the rack.

2. The shelving system of claim 1, wherein the bracket comprises a lug, and the bracket is configured to be inserted into the vertical beam slotted hole through the lug to realize a detachable connection to the vertical beam.

* * * * *